US005551909A

United States Patent [19]

Bailey

[11] Patent Number: 5,551,909

[45] Date of Patent: Sep. 3, 1996

[54] METHOD AND APPARATUS FOR CLEANING WITH HIGH PRESSURE LIQUID AT LOW FLOW RATES

[76] Inventor: Donald C. Bailey, 106 Redwood Ct., Summerville, S.C. 29483

[21] Appl. No.: 348,863

[22] Filed: Nov. 28, 1994

Related U.S. Application Data

[60] Continuation of PCT/US94/05850, May 25, 1994, Continuation-in-part of Ser. No. 067,056, May 26, 1993, abandoned, which is a division of Ser. No. 635,949, Dec. 28, 1990, Pat. No. 5,220,935.

[51] Int. Cl.[6] ..... B24C 3/00

[52] U.S. Cl. ..... 451/75; 451/102

[58] Field of Search ..... 451/410, 439, 451/424, 429, 75, 102

[56] References Cited

U.S. PATENT DOCUMENTS

| | | | |
|---|---|---|---|
| 3,925,935 | 12/1975 | Ricklefs | 451/8 |
| 4,149,345 | 4/1979 | Atsuchi | 451/424 |
| 4,218,855 | 8/1980 | Wemmer | 51/439 |
| 4,478,368 | 10/1984 | Yie | 239/430 |
| 4,522,738 | 6/1985 | Magid et al. | 252/90 |
| 4,555,872 | 12/1985 | Yie | 51/439 |
| 4,563,840 | 1/1986 | Urakani | 451/410 |
| 4,648,215 | 5/1987 | Hashish et al. | 451/439 |
| 4,715,539 | 12/1987 | Steele | 239/263 |
| 4,817,874 | 4/1989 | Jarzebowicz | 239/434 |
| 4,836,455 | 6/1989 | Munoz | 239/590 |
| 4,872,615 | 10/1989 | Myers | 239/587 |
| 4,945,688 | 8/1990 | Yie | 451/439 |
| 4,984,396 | 1/1991 | Urakami | 451/92 |
| 5,018,670 | 5/1991 | Chalmers | 239/433 |
| 5,092,085 | 3/1992 | Hashish et al. | 51/439 |
| 5,155,946 | 10/1992 | Domann | 451/410 |

FOREIGN PATENT DOCUMENTS 1-115572 5/1989 Japan .

*Primary Examiner*—Bruce M. Kisliuk
*Assistant Examiner*—Andrew Weinberg
*Attorney, Agent, or Firm*—Pollock, Vande Sande & Priddy

[57] ABSTRACT

A high pressure water cleaning method and apparatus using a nozzle assembly wherein abrasive particles (172) are separated from a transport gas and injected into a high pressure water spray within an impact and mixing chamber (320) at an incidence angle (MA, MA') and velocity sufficient for the separated particles to penetrate into and thereby mix with a high velocity core (360) of the water spray (FS). The spray pattern is preferably fanned shaped instead of cone shaped, and preferably does not touch at least one outlet passage wall downstream of the impact chamber (320) to provide an exit flow path (AG) for the separated transport gas. For this purpose, an axis (CL) of the spray pattern may be offset (OS) from the center (SC) of the outlet passage (302) of the nozzle assembly, which may be either fixed (280, 285) or rotated (650).

36 Claims, 16 Drawing Sheets

174
170
146
220
222
91
90
92
224
233
173
69
242
144
147
142
131
151
230
226
214
213
118
225
120
216
218
236
228
148

METHOD AND APPARATUS FOR CLEANING WITH HIGH PRESSURE LIQUID AT LOW FLOW RATES

This is a Continuation of co-pending PCT International Application No. PCT/US94/05850 filed May 25, 1994, and a Continuation-In-Part of application Ser. No. 08/067,056 filed May 26, 1993, and now abandoned which is a division of Ser. No. 07/635,949 filed Dec. 28, 1990 now U.S. Pat. No. 5,220,935 the entire contents of which are expressly incorporated herein by reference.

FIELD OF THE INVENTION

The present invention relates to a method and apparatus for cleaning deposits or coatings of undesirable materials from underlying surfaces, and in particular relates to a cleaning method and apparatus that use a high pressure flow of cleaning liquid at relatively low volumetric flow rates to provide a high velocity spray which may be directed toward a surface to clean it of deposits and/or coatings.

BACKGROUND OF THE INVENTION

In many industrial environments, it is common for deposits of chemical residues or coatings of scale or other undesirable materials to accumulate on surfaces of equipment and buildings during their ordinary use. This problem also may occur in domestic environments. In some instances, the deposits or coatings may be merely unattractive, whereas in other situations, they may interfere with the normal function of the surface on which they have accumulated.

In the past, a variety of means have been used to clean away such deposits, including manual scrubbing with strong detergents or hard abrasive compounds. Alternatively, high pressure cleaning with large volumes of water or another cleaning liquid, sandblasting, or steam cleaning have been used.

One common example of a previously unresolved cleaning problem is the task of cleaning old paint from aluminum surfaces, such as those of an airplane. When used to clean painted aluminum, the known cleaning methods have not provided satisfactory results for a variety of reasons. Aluminum is a relatively soft substance, particularly in thin sheets. Scrubbing with a steel wire brush may fail to produce satisfactory cleaning results because the steel wire is harder than the aluminum, which results in the wire brush penetrating and damaging the aluminum surface by the scrubbing action. In addition, both manual and machine scrubbing are labor intensive. Thus, these means have failed to give satisfactory results in removing old paint and other deposits from aluminum surfaces.

The use of high pressure liquid cleaning methods heretofore known also have not proven to be advantageous because the high volumetric flow requirement presents the problem of disposing of the large quantities of liquid waste run off.

Another problem associated with high flows of cleaning liquid arises from an excessive impact. This impact, which results from the use of high volumetric flow rates at high pressures, may damage the surface or warp the aluminum. Thus, there has been a need to circumvent the effluent discharge problems and the adverse impact effects associated with high volumetric flow rates used in conventional liquid cleaning systems.

Fluid suspended abrasives also have been used in the past to clean coatings and other deposits from underlying surfaces. The propelling fluid used is generally a gas such as air and the abrasive may be particles of sand, salt, sodium bicarbonate, potassium bicarbonate, and the like. A liquid, such as water, has sometimes been added in relatively small amounts (e.g. less than 0.5 gpm) to reduce the dust generated by the blasting operation when the fine abrasive particles are suspended in the gaseous propellant. Although high pressure water has been injected into the gaseous stream for this purpose, the volume of the injected water relative to the volume of the propelling air has been too small to add much kinetic energy (velocity) to the particulates carried by the air.

DISCLOSURE OF THE INVENTION

An overall purpose of the present invention is to overcome the aforementioned deficiencies by providing an effective liquid and light weight grit (abrasive) cleaning medium which minimizes the amounts of liquid, grit and transport gas used to generate the medium, and which generates the medium using less energy more efficiently. For example, the present invention is capable of doing generally the same amount of cleaning work using as little as ¼ to 1/10 of the horsepower employed in prior art devices utilizing high pressure water with and without grit.

The method and apparatus of the invention achieve these objectives by providing a flow of liquid under pressure from a liquid supply means to a liquid orifice defined by a nozzle member of a nozzle means, and a flow of abrasive particles admixed with and propelled by a transport gas under pressure from a media supply means to a media opening of the nozzle means; discharging a liquid spray through the liquid orifice into an impact chamber along a spray axis, wherein the mixing chamber is defined by the nozzle means; discharging the admixture of abrasive particles and transport gas through the media opening into the impact chamber along a media axis; and conveying the transport gas and a mixture of the abrasive particles and the liquid spray to the outside of the nozzle means through an outlet communicating with the impact chamber and defined by the nozzle means, wherein the liquid spray has an inner core substantially free of the transport gas, the media axis defines an incidence angle relative to the liquid spray axis, and the velocity of the particles discharged along the media axis and the incidence angle are sufficient to separate the abrasive particles from the transport gas and cause at least a substantial portion of the separated abrasive particles to impact said liquid spray with sufficient kinetic energy to penetrate into its inner core.

The cleaning method and apparatus of the invention are useful for cleaning surfaces formed of relatively hard materials which are contaminated with relatively hard deposits of undesirable materials that are difficult to remove by conventional washing or abrading cleaning methods. The invention may be used to clean paint, scale and other coatings from easily damaged surfaces. Likewise, the invention may be used to clean deposits from metal machine surfaces. Thus, it is useful in cleaning deposits from the rolls of industrial equipment used for handling web materials such as paper, rugs and other textiles, or for handling synthetic fibers in filament or tow form. The invention may be used to clean away a variety of deposits, such as dirt, latex or acrylic binders, finishing oils, waxes, paint, plastics, oligomers, finishes, inks, dyes, or other chemical residues or deposits that periodically accumulate on surfaces during operation of rolls, drums, vessels and other industrial equipment.

The invention is particularly useful for cleaning the surfaces of fragile materials such as the thin metal sheets used in making the skins of aircraft components. These materials are very sensitive to the deformation which may be caused by the impact of a cleaning spray, particularly where the spray contains abrasive materials. Therefore, an initial cleaning step may use water only, followed by a second cleaning step with a small flow rate of abrasive media. For example, in cleaning aircraft components with a fan spray ejected at a flow rate of about 3 to about 4 gpm and a pressure of about 15,000 to 17,000 psig, 100% of a polyurethane top coat and about 20% to about 50% of an epoxy primer may be removed with only the water spray and the remainder of the primer may then be removed by adding a small flow rate of media particles to the water spray. Alternatively, 100% of both the top coat and the primer may be removed in about the same amount of time by initially adding about 0.5 #/m (pounds per minute) to about 1.0 #/m of media particles to the water spray. Both of these operations minimize the residual stresses in the thin metal skin caused by removal of the paint.

Another preferred embodiment of the invention uses a pressure of between about 9,000 psi and about 20,000 psi, preferably about 15,000 psi, and a volumetric flow rate of greater than about 2.0 gpm, preferably between about 2.5 and about 5.0 gpm, more preferably about 3.2 gpm, to clean paint from metal surfaces. An embodiment for cleaning grout utilizes a pressure of between about 8,000 and 9,000 psi and a lower volumetric flow rate of between about 0.3 and 0.5 gpm, preferably a pressure of about 9,000 psi and a flow rate of about 0.33 gpm. Furthermore, pressures of between about 10,000 psi and 15,000 psi are sufficient to clean most common undesired deposits from the surfaces of rolls used in textile, printing or fiber machinery at a volumetric flow rate of between about 0.5 to 1.5 gpm, although flow rates between about 2.0 and about 5.0 are preferred. When used to clean industrial rolls on web or fiber handling machinery, a pressure of about 11,500 psi at a flow rate of about 0.75 gpm is satisfactory, although a flow rate greater than 2.0 gpm is preferred. However, it is to be noted that pressures as high as 30,000 to 36,000 psi and flow rates as high as 25 gpm may sometimes be required to remove stubborn deposits.

The pressure to be used is selected by directing a solid stream of the cleaning liquid through a standard round orifice to a test surface and increasing the pressure thereof until a small deposit of undesirable material is removed. Thereafter, the desired liquid flow rate is determined by selecting a nozzle tip according to the invention that will provide a liquid spray with a solid inner core and has the smallest orifice size and shape that will give the desired cleaning pattern. Thus, the minimum pressure and flow rate combination may be selected for use in cleaning.

Cleaning liquids that may be used in conjunction with the present invention include water, a solution of a cleaning compound and water, or some other liquid. A detergent may be added to the water for improved cleaning performance in some applications. The water, or other cleaning liquid, may be substantially free of abrasives or other particulate material.

However, in applications requiring the removal of paint or stubborn stains or hard deposits, light weight abrasives, preferably having a density less than water, are preferably injected into the cleaning liquid spray by a special nozzle head which injects the abrasive particles into the core portion of the liquid spray after it is ejected from a nozzle orifice into a nozzle mixing chamber. The ratio of abrasive particles to liquid spray may vary over a relatively wide range depending upon the application, but this ratio is generally in the range of about 0.01 to about 1.0 #/gal (pounds per gallon), preferably about 0.1 to about 0.5 #/gal, more preferably about 0,125 to about 0.333 #/gal.

The abrasive particles are preferably "soft" abrasives having a Moh hardness of about 2 to about 5, preferably about 2.5 to about 4.5 more preferably greater than about 3 and less than about 4. Suitable abrasive particles may be made from dehydrated sodium tetraborate, sodium tetraborate decahydrate, sodium tetraborate pentahydrate, sodium sulfate, sodium sulfite, sodium carbonate, sodium bicarbonate, sodium nitrite, sodium nitrate, potassium carbonate, potassium bicarbonate, calcium carbonate, corn cobs, walnut shells, and light plastic materials. Baking soda is especially suited for many applications due to its sterilizing effect on the surface on which it is sprayed. Various other water soluble salts also may be used, although they are less preferred.

The use of such soft abrasives combines the soft abrasive effect with the cleaning effect of the cleaning liquid spray. Where the abrasive particles are water soluble, the spent abrasive does not result in solid waste, but instead may be drained away and disposed of with the water. Anti-caking and/or flow assist additives may be mixed with the abrasive particles to facilitate the flow and air transport thereof, one such additive being a dimethyldichlorosilane available under the tradename AEROSIL.

Additionally, in particularly difficult environments, the surface to be cleaned may be pre-treated with a chemical such as an enzyme to soften accumulated deposits prior to directing the high pressure spray of cleaning liquid toward the surface. In the absence of soluble abrasives, the cleaning liquid also may be preheated to a temperature of at least about 90° F. to enhance its cleaning performance.

The nozzle head of the invention may be held in position by hand when incorporated into a gun assembly with hand grips or handles. When used to clean an industrial machine roll or drum, the nozzle head is preferably mounted on a traversing device which moves the nozzle head through a horizontal plane in close conjunction with the cylindrical surface so that the high pressure spray may be directed thereon. The roll or drum is generally rotated during this process so that the rate of turning and the rate of lateral motion of the nozzle head produce complete cleaning of the surface of the roll or drum with a single pass of the spray. Such a traversing device is described in U.S. Pat. No. 5,220,935, the entire contents of this patent being incorporated herein by reference.

BRIEF DESCRIPTION OF THE DRAWINGS

The foregoing and other objects, advantages and features of the invention, and the manner in which the same are accomplished, may be better understood by consideration of the following detailed description of the invention taken in conjunction with the accompanying drawings, in which.

DETAILED DESCRIPTION OF THE INVENTION

Figure 1:
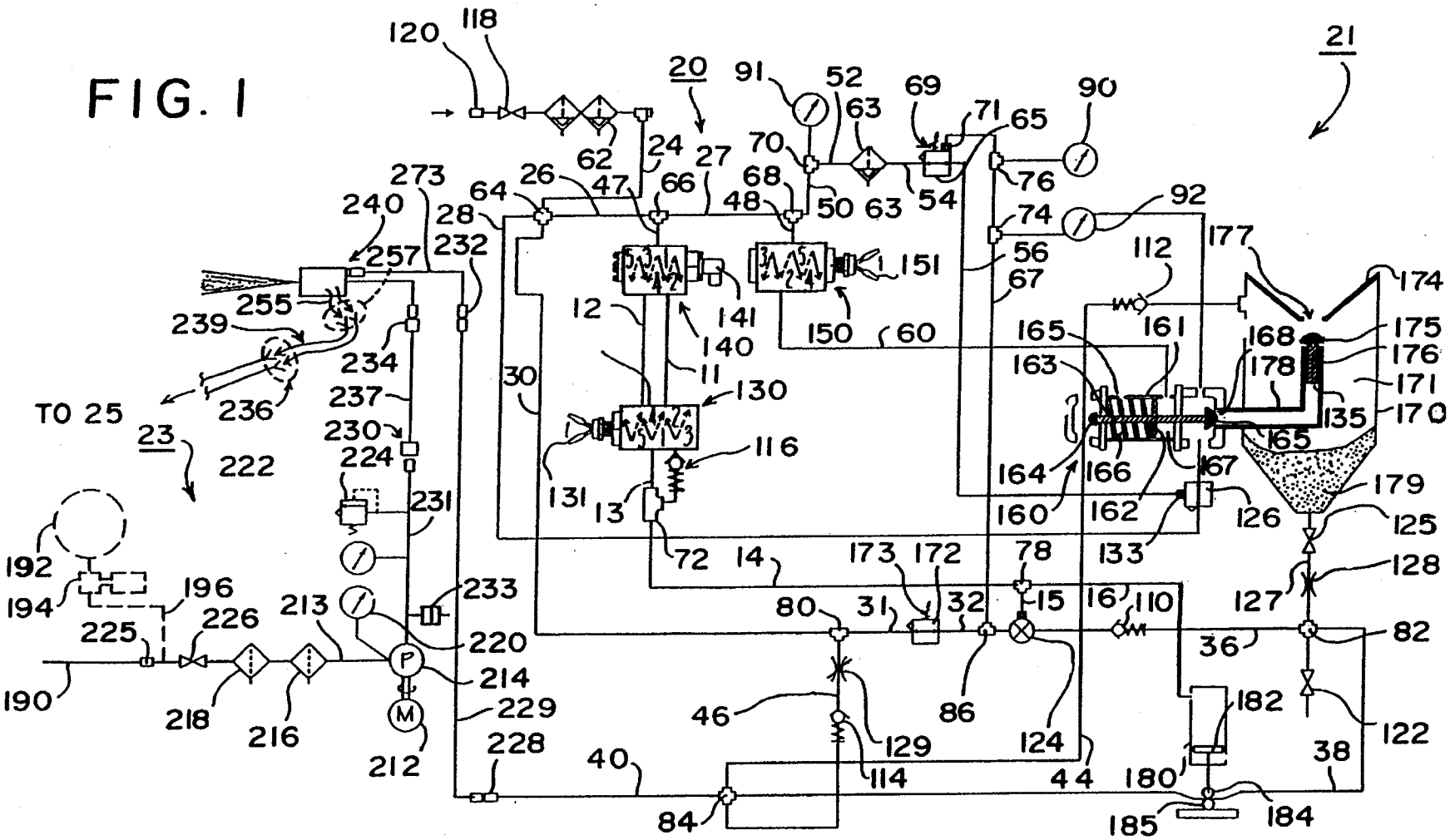
FIG. 1 is a schematic diagram of the gaseous, media (grit) and liquid fluid systems of the invention.

The present invention includes an air system 20, a media system 21 and a water system 23 which cooperate to discharge a particulate media through a fan gun 240.

Considering first the air system, a source of air (not shown) at a pressure in the range of about 30–150 psig, preferably about 100 to about 120 psig is connected to a valve 118 through a coupling 120, where it passes through a filter/dryer unit 62. Filtered and dried air from unit 62 passes through a line 24 to a junction 64 which splits the inlet air into three streams, one going into line 26, one into line 28 and one into line 30. As will be described in more detail below, a first portion of the air in line 26 may be passed through a tee 66 into a media solenoid 140. A second portion of the air in line 26 passes through a tee 68 into a pot switch 150 via interconnecting lines 27 and 48. A third portion of the air in line 26 passes through a tee 70 and a 0.5 micron filter 63 into a differential pressure regulator 65 via interconnecting lines 50, 52 and 54.

Air in line 30 is split at a tee 80 into a stream 46 and a stream 31. Stream 46 passes through a constant bleed orifice 129, and air stream 31 passes into a system pressure regulator 172, and then to a pilot operated transport air valve 124 via a tee 86 and an interconnecting line 32. A portion of the air from stream 31 then passes through a check valve 110 into a line 36 connected to a four-way junction 82. Air from line 36 is mixed in junction 82 with particulate media which flows a from media pot 170 via a ball valve 125 and a media orifice 128 in a line 129.

Air in line 28 passes to a pot pressure slave valve 126 which controls the pressure of air fed to pot 170 through a pot control valve 160. Pot control valve 160 comprises a piston 162 mounted within a cylinder 161, a piston rod 163 with elastomeric end portions 164 and 165 at each end. Piston 162 causes elastomeric end portion 164 to pinch off air flowing through a resilient portion of a line 44 and simultaneously to retract elastomeric end portion 165 to open an entrance opening 168 into a passage 178 within media pot 170. The pot pressure slave control valve 126 controls the pressure above the media bed 179 within media pot 170. Pot pressure forces media particles (grit) from media bed 179 through valve 125 and media orifice 128 such that it is mixed in junction 82 with transport air from line 36 and is carried by this air through a quick coupling 228 and a quick coupling 232 to the fan gun 240. The pressure of the air and media provided to gun 240 is regulated at a pressure of between about 20 and about 100 psig., preferably between about 40 and 60 psig, and more preferably at about 50 psi, for flow rates in the range of about 5 to about 30 standard cubic feet per minute, preferably about 10 to about 20 standard cubic feet per minute. This flow rate is more preferably about 15 standard cubic feet per minute for a pump motor 212 of about 25 horsepower.

Fan gun 240 is provided with highly pressurized water from a pump 214, which is preferably a triplex plunger pump operated by an air or electric motor 212 preferably rated at about 25 horsepower for a pump output pressure of 15,000 psig. Alternately, there may be used a gas driven hydraulic pump, such as that shown and described in U.S. Pat. No. 5,116,,425 issued May 26, 1992, the entire contents of this patent being expressly incorporated herein by reference. The reservoir disclosed in this patent also may be used with the present invention. The cleaning liquid should be pressurized to at least about 5,000 pounds per square inch (psi), and for certain applications, it may be pressurized up to about 36,000 psi.

While so pressurized, the cleaning liquid is forwarded from the pump at a flow rate of about 0.33 to about 25 gallons per minute (gpm), preferably about 2 to about 5 gpm, more preferably about 3.0 to about 4.0 gpm. For certain applications where grout is to be cleaned by removal of relatively soft or moderately hard embedded deposits of undesirable materials, or where hard coatings have been rendered softer by a solvent or the like, the flow rate may be less than about 1.5 gpm, and preferably between about 0.3 and 1.0 gpm at a pressure of between about 5,000 and about 15,000 psi. For other applications where metal is to be cleaned by removal of paint or other hard coatings, the flow rate is preferably about 3.2 gpm at a pressure of between about 15,000 and about 20,000 psi.

For example, pressurizing the cleaning liquid to a pressure of at least about 8,000 psi at a volumetric flow rate of no more than about 1.0 gpm may be sufficient to remove from many surfaces deposits of the type that cannot be removed by mechanical scrubbing without damaging the surface itself. In one such embodiment for cleaning tile grout or the like, a cleaning liquid pressure of between 8,000 to 9,000 psi in conjunction with a volumetric flow rate of between about 0.3 and 0.5 gpm is sufficient to remove undesired deposits that are embedded in the grout.

Moderate pressure water is introduced from a source thereof, such as a garden hose, through a coupling 225 connected to a ball valve 226. Alternatively, the water source may be reservoir 192 supplying a moderate pressure feed pump 194 connected by a line 196 to valve 226. The water flows through a 20 micron filter 218, a 0.5 micron filter 216, and a line 213. Although the water supplied to valve 226 may be at atmospheric pressure, it is preferably at moderate pressures typical of industrial or domestic water supplies, which are generally in a range between about 50 and 140 psi (35 to 125 psig).

Pump inlet pressure in line 213 is measured by an inlet water pressure gauge 220, and pump outlet pressure in line 231 is measured by a pump outlet pressure gauge 222. Over pressurization of line 231 is prevented by a pressure relief valve 224 set at about 15% higher than desired operating pressure, and a rupture disk 233 set at about 20% higher than desired operating pressure.

Figure 2:
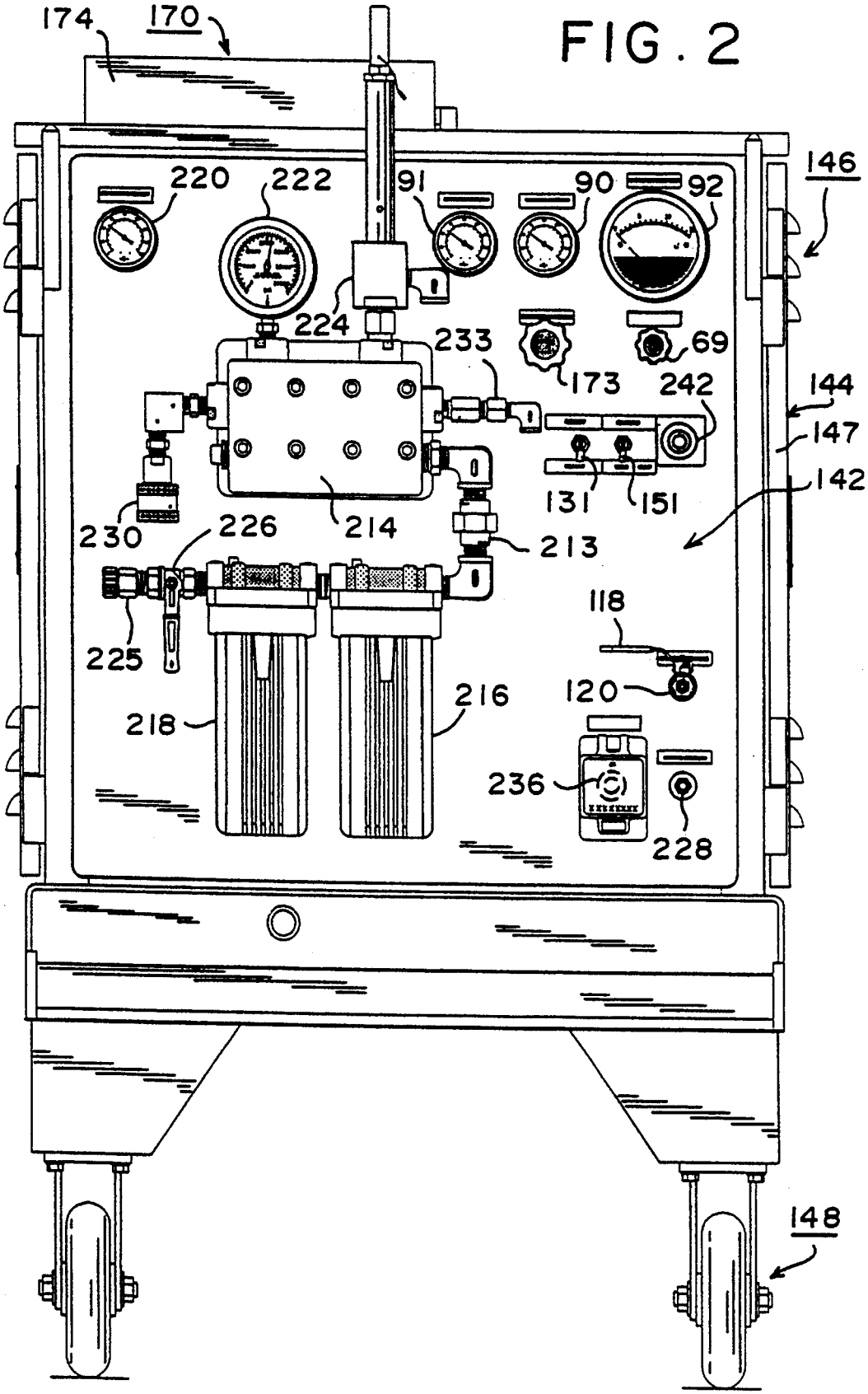
FIG. 2 is a front elevational view of an instrument panel for controlling individual components shown in FIG. 1.

A hose 237 of variable length connects quick coupling 230 of the water system to quick coupling 234 of the fan gun, a media hose 229 of variable length connects quick coupling 228 of the media system to quick coupling 232 of the fan gun, an electrical cable 239 of variable length connects electrical cable 225 and electrical connector 257 of the fan gun to the electrical system 25 of the invention via a control cable receptacle 236 on an instrument panel 142 (FIG. 2).

The manner in which the particulate media is fed to the fan gun at 240 will now be described. When toggle 151 of pot switch 150 is placed in the charge position, system air passes through line 48, pot switch outlet port 2 and line 60 to pot control valve 160, thereby pushing piston 162 and its rod 163 to the left (FIG. 1) to close line 44 and open line 178. At the same time, air from regulator 65 is fed to a reference pressure sensor 133 of pressure slave valve 126 to pressurize pot 170 at the pressure in sensor line 56, which causes pop up plunger 175 to close opening 177 of media hopper 174. Pressurized air from line 28 is fed to the closed hopper chamber 171 via an air gap 135 between the inside of line 178 and the surface of rod 176 of pop up plunger 175. The air pressure in pot chamber 171 is maintained in the range of about 1 to about 5 psi, preferably about 2–3 psi, above the system air pressure in line 36 by differential pressure regulator 65. This pressure differential is sufficient to provide the desired flow of media particles through orifice 128 and into junction 82 for mixing with a flow of system air through line 36 when transport air valve 124 is in its open position.

As soon as system air is supplied at air inlet 120, transport air valve 124 is held in its closed position by the pressure of a pilot air supplied to tee 78 via media solenoid 140, media switch 130 and interconnecting lines 47, 11, 13 and 14. This pilot air is also supplied through line 16 to a pinch valve 180 where it acts on piston 182 to keep the pinch valve head 184 pressed against its seat 185, thereby closing off a flexible portion of line 38. The pilot air pressure is maintained through ports 2 and 3 of the media switch when its toggle 131 is in the rinse position and through ports 2 and 1 when its toggle 131 is in the media position. At this time, media solenoid 140 is deenergized such that pilot air flows through its ports 3 and 2.

When the media switch toggle 131 is in its media position, the air system 20 is in a condition for actuation of the media flow in response to actuation of the trigger of fan gun 240, which in turn actuates a switch that energizes media solenoid 140.

When media solenoid 140 is energized in response to the fan gun switch, its ports 3 and 4 are aligned so as to vent the pilot air in lines 14, 15 and 16 via lines 13 and 11, which in turn opens transport valve 124 and pinch valve 180 such that system air flows through junction 82 where it picks up the media particles and transports them to fan gun 240 through lines 38 and 40. The transport air flow is preferably in the range of about 5 to about 30 standard cubic feet per minute (scfm), preferably about 10 to about 20 scfm, more preferably about 14 to about 16 scfm, most preferably about 15 scfm, at respective transport air pressures of about 20 to about 100 psig, preferably about 40 to about 60 psig, more preferably about 47 to about 53 psig, most preferably about 50 psig.

Since the transport air is pressurized, its flow rate is substantially independent of the water flow rate because it is not a siphoned flow induced by water spray suction, such as used in venturi type nozzles. However, the particular air flow rate selected is based, at least in part, on the water flow rate selected for nozzle tip 282, the water to air ratio (gal/scf) being at least 0.01, preferably about 0.1 to about 1.0, more preferably about 0.2 to about 0.5. For example, this ratio is 0.21 for a water flow of 3.2 gpm and an air flow of 15 scfm, and these flows may be used to propel a particle flow of one (1.0) pound per minute.

The media orifice 128 is sized relative to the transport air flow and the transport air pressure, and a predetermined differential pressure between the transport air and the media supply chamber is maintained substantially constant by differential pressure regulators 65 and 172 to provide a particle flow of about 0.1 to about 10 pounds per minute (#/m), preferably about 0.25 to about 3 #/m, more preferably about 0.5 to about 2 #/m, most preferably about 1.0 #/m. These low particle flow rates, in combination with the fan spray nozzle operated at the preferred water pressures and flows, minimize the deformation caused by the impact of the spray against the surfaces of fragile materials, such as the thin metal skins of aircraft components made of aluminum and the like.

Supply pressure is measured by a supply pressure gauge 91, system pressure downstream of system pressure regulator 172 is measured by system pressure gauge 90, and differential pressure between system pressure and pot pressure is measured by a differential pressure gauge 92. System pressure regulator 172 has a control 173 for adjusting the pressure downstream of this regulator. Differential pressure regulator 65 has a reference pressure connection 71 connected by a bias line 67 to junction 86 downstream of system pressure regulator 172 to thereby provide a reference or bias pressure which causes regulator 65 to provide this same pressure in its output line 56, unless the output pressure is adjusted upward by a differential pressure control 69. The differential pressure referred to above between media chamber 171 and transport line 36 is provided in response to adjusting differential pressure control 69. The predetermined differential pressure may be between about 0.5 psi and about 10 psi, preferably about 1.0 to about 5.0 psi, more preferably about 1.5 to about 2.5 psi, and most preferably about 2 psi.

The media supply means 21 thus comprises means 170 having an interior chamber 171 for containing a supply of abrasive particles 172 under pressure, gas supply means 20 for supplying transport gas under pressure to the containing means 170 and to conduit means 36 for admixing the abrasive particles 172 and the transport gas and for conveying the resulting admixture to the media opening 324, and pressure regulating means 65, 172 for providing a pressure differential between the interior chamber 171 of the containing means 170 and the conduit means 36 while the admixture of abrasive particles and transport gas are being conveyed to the media opening 324. The pressure regulating means 65, 172 further comprises means 69, 173 for selecting a differential pressure and means 71, 133 for maintaining the selected differential pressure substantially constant over a substantial range of pressures (for example, 20 to 90 psig) of the transport gas supplied by the gas supply means 20.

When a media feed to fan gun 240 is no longer desired, the toggle 151 of pot switch 150 is moved from the charge position to the pot vented position, which connects line 60 to vent port 3 thereby venting chamber 167 of pot control valve 160 and causing piston 162 to be moved to the right (FIG. 1) via compression spring 166. This movement of piston 162 opens line 44 to atmospheric pressure through fan gun 240 so as to release pressure in the pot chamber 171 through check valve 112. Air pressure in line 178 is also released around rod 176 of pop up plunger 175 because opening 168 to line 178 is closed by elastomeric valve head 165. The release of pressure from line 178 causes retraction of pop up plunger 175, thereby opening pot chamber 171 to atmosphere through hopper opening 177.

With pot chamber 171 open to atmosphere, air may continue to flow through transport line 36 and junction 82 without picking up any significant media. In order to stop the flow of transport air through line 36, the toggle 131 of media switch 130 is moved to the rinse position. With toggle 131 in this position, transport valve 124 and pinch valve 180 are closed in response to the return of pilot air to lines 14, 15 and 16 via ports 3 and 4 of media solenoid 140, line 12, ports 4 and 1 of media switch 130 and line 13, while fan gun 240 continues to discharge water in response to operation of its trigger. Thus, fan gun 240 may be used for cleaning by water impact only since no abrasives are discharged.

During cleaning operations with water alone, as well as when there is no water flow, system air continues to flow through constant bleed orifice 129 at a flow rate in the range of about 1 to about 5 scfm, preferably about 2 to about 3 scfm, in order to keep dry the passageways in fan gun 240 for feeding the admixture of transport air and abrasive particles (media) to the water stream. Check valve 114 prevents reverse flow of media through line 46 when transport air valve 124 is open to transport the media to fan gun 240. Check valve 112 prevents a similar reverse flow through line 44 when pot chamber 171 is depressurized.

When the trigger of fan gun 240 is released, media solenoid 140 returns its ports to their rest positions represented by the solid lines depicted within the body of the solenoid. In these positions, the slide valve (not shown) of the solenoid connects line 47 to line 11 through ports 3 and 2, and air from line 11 is provided to pilot lines 14, 15 and 16 via ports 2 and 3 of media switch 130 and check valve 116. Also, bleed air continues to flow through line 46 via line 30 until air supply valve 118 is closed.

Release of the fan gun trigger also turns off motor 212 and thereby deactivates pump 214. Thereafter, fan gun 240 may be disconnected from the media system 21, the water system 23, and the electrical system 25 by disconnecting couplings 232, 234 and 236, respectively.

In FIG. 2 there is illustrated an instrument panel 142 on which is also mounted various components of the air system, the media system and the water system of the invention. Instrument panel 142 is mounted on one face of a cabinet 144 which serves as a housing for media pot 170 and still other components of the four main systems. Cabinet 144 has louvers 146 to provide natural convection airflow through the cabinet for cooling the heat generating components mounted therein, and two pairs of wheels 148 (only one pair being shown) to provide hand-pushed mobility of the entire cabinet. Mounted on instrument panel 142 of cabinet 144 are inlet water pressure gauge 220, outlet water pressure gauge 222, water relief valve 224, air supply pressure gauge 91, system air pressure gauge 90, differential pressure gauge 92, system pressure regulator control 173, differential pressure regulator control 69, the female half of inlet water coupling 225, water inlet valve 226, coarse water filter 218, fine water filter 216, line 213, plunger pump 214, over pressure ruptured disk 233, the female half of high pressure water coupling 230, media switch toggle 131, pot switch toggle 151, on-off switch 242, air supply valve 118, the female half of air coupling 120, the female half of media coupling 228, and control cable receptacle 236.

Figure 3:
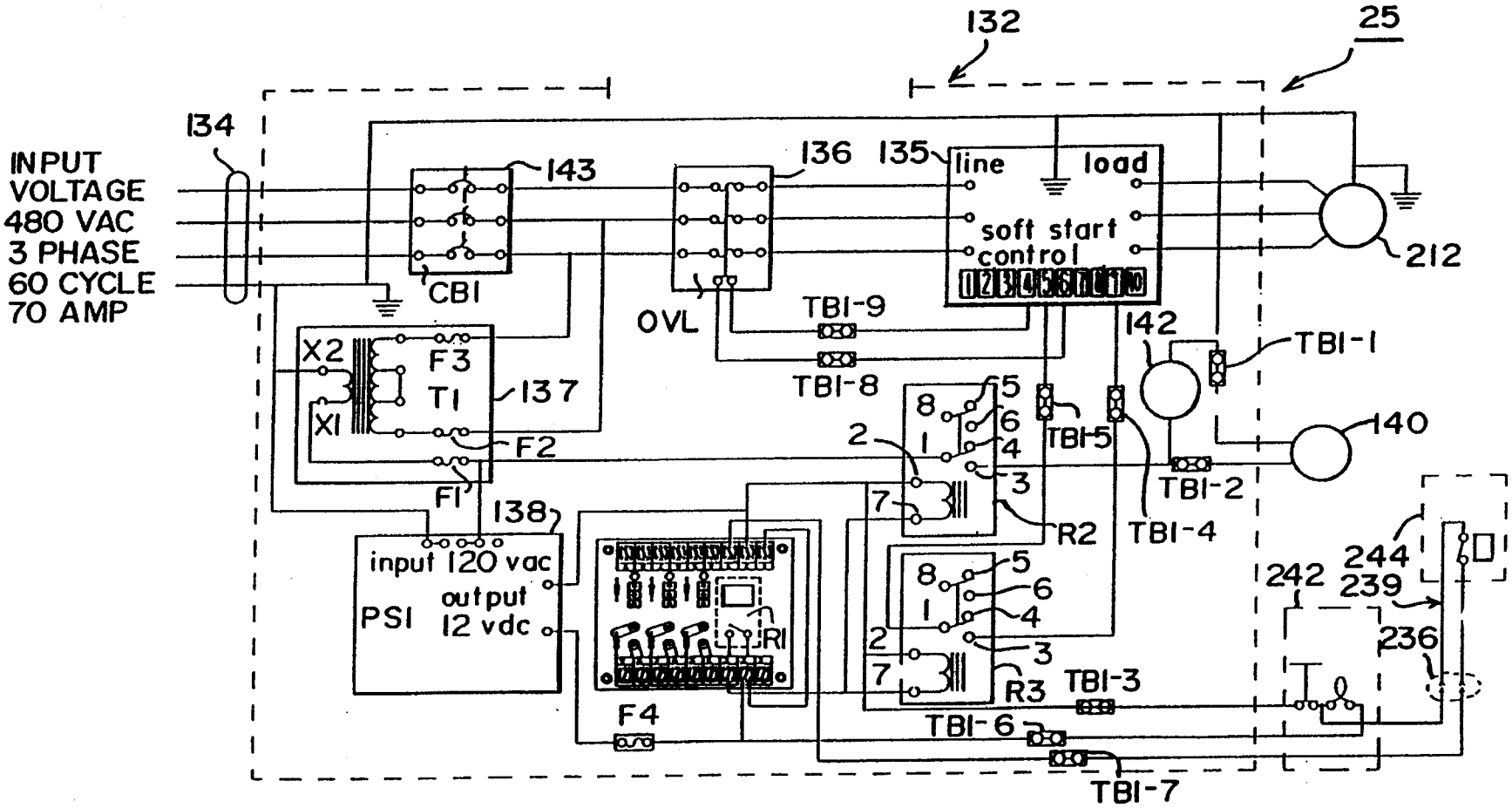
FIG. 3 is a schematic diagram of the electrical system for operating individual electrical components shown in FIG 1.

Referring to FIG. 3, inside of cabinet 144 there is provided a power distribution panel 132 on which are mounted certain components of the electrical system 25. The components mounted on distribution panel 132 include a door interlock 143 which interrupts the electrical power supplied to an input receptacle 134 when a side door 147 of cabinet 144 is open. Also mounted on distribution panel 132 is a starter control 135 and a thermal overload switch 136 for pump motor 212. A transformer 137 steps down a three phrase alternating current power source from 480 volts to 120 volts which are then inputted to an ac to dc converter 138 to provide a dc power supply of 12 volts for operating the media solenoid 140, an hour meter 142, and the electrical components, including the relays R1, R2 and R3, for controlling operation of the pump motor 212 and the media solenoid 140 in response to actuation of on-off switch 242 and fan gun switch 244. When on-off switch 242 is in its on position, operation of pump motor 212 and media solenoid 140 depends on the closing of magnetic switch 244 which is actuated in response to the close proximity of a permanent magnet in trigger 252 when it is pulled toward handle grip 253.

Figure 4:
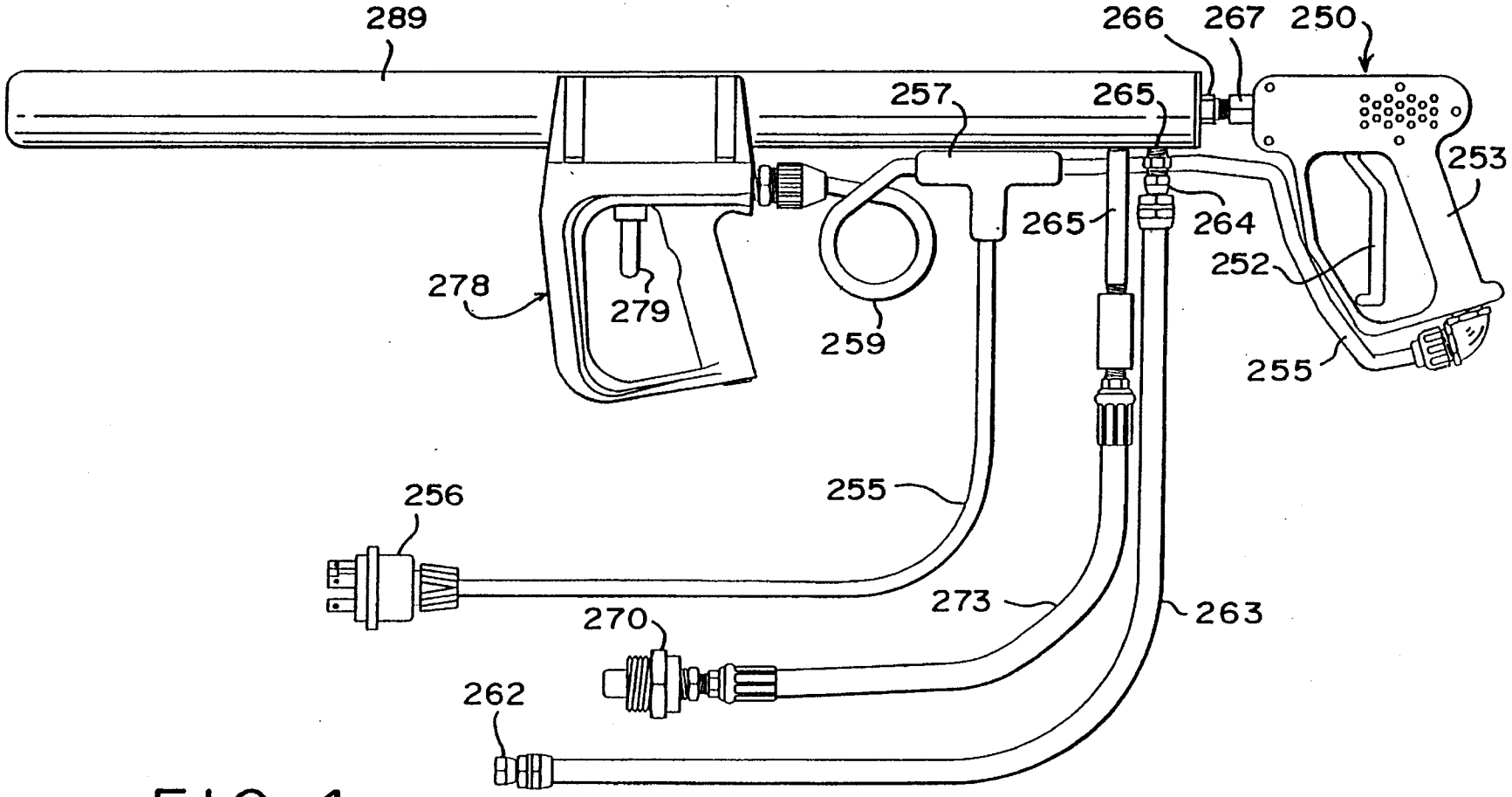
FIG. 4 is a side elevational view of a fixed head fan gun assembly of the present invention.
Figures 5, 6:
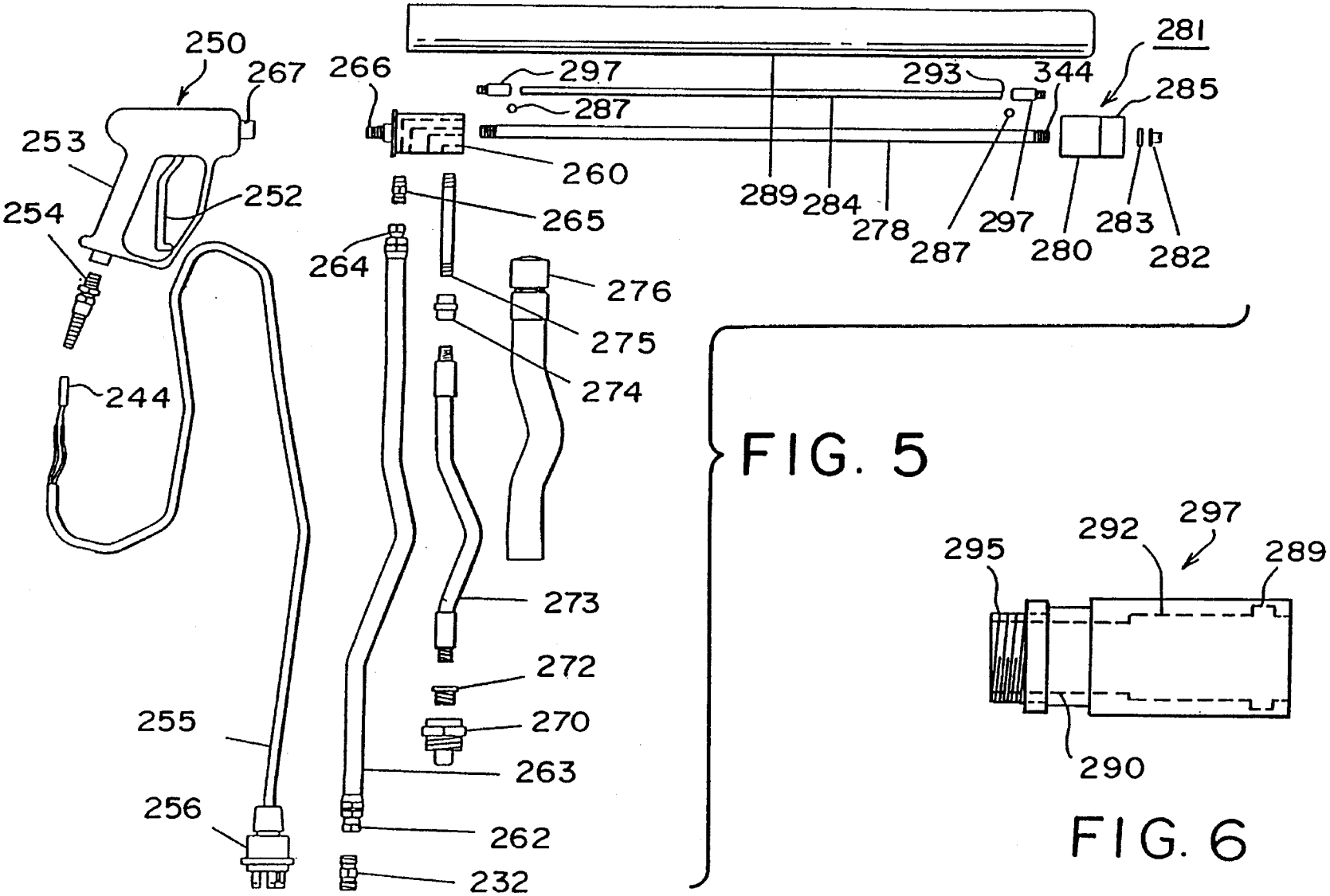
FIG. 5 is an exploded view illustrating individual components of the fan gun assembly of FIG. 4.
FIG. 6 is a side elevational view of the media tube socket showman FIG. 5.

The components of the fan gun are illustrated in FIGS. 4 and 5. These components include a gun handle 250 having a trigger 252 for actuating the switch 244 which is secured within the grip 253 of gun handle 250 by a watertight connector 254. A short gun control cable 255 is connected to a variable length control cable 239 by means of a male plug 256 which is received in a receptacle 257 (FIG. 1) of the variable length cable 239.

The variable length media hose 229 is connected to a gun base 260 via hose coupler 232, a hose fitting 262, a short hose 263, a hose fitting 264, and a hose to base adapter 265. A threaded portion 266 of base 260 is threaded into a barrel 267 of gun handle 250.

Variable length high pressure water hose 237 is connected to the base 260 via a male portion 270 of quick coupler 234, a reducer bushing 272, a short section 273 of high pressure hose, a pressure coupling 274, and a high pressure nipple 275. A safety shroud 276 may be provided to enclose the foregoing high pressure water elements between base 260 and the male coupler 270. An auxiliary handle 278 (FIG. 4) may optionally be provided as a second grip for holding the gun secure against relatively high reaction forces caused by ejection of the water and media spray at the high end of the flow rate ranges described herein. Handle 278 also may optionally be provided with a safety switch 279 which is electrically connected to cable 255 by an auxiliary cable 259 and an electrical tee 257.

The water fed to gun base 260 is conveyed to a nozzle body 280 of a nozzle head assembly 281 via a long high pressure water tube 278 which is threaded into both base 260 and nozzle body 280. As described more fully below, a nozzle tip 282 and a nozzle gasket 283 are seated securely in nozzle body 280 by means of a nozzle cap 285. Media (the admixture of abrasive particles and transport air) is conveyed from base 260 to nozzle body 280 via a media tube 284 which is held at opposite ends by a pair of sockets 297, 297 threaded respectively into base 260 and nozzle body 280 and engaging the media tube 284 by means of corresponding O-rings 287, 287. A gun cover 289 extends between base 260 and nozzle body 280 and surrounds the components therebetween so as to protect the media tube from damage and also to serve as a safety shroud around high pressure water tube 278.

Referring now to FIG. 6, there is shown the media tube socket 297 which has an 0-ring groove 289 for receiving the O-ring 287. Upstream of a media passage 290 is a counter bore 292 for slidingly receiving a smooth end 293 of the media tube 284. A threaded end 295 is threaded either in gun base 260 or in nozzle head 280. The sealed but sliding connections thereby provided at each end of the media tube 284 allows the media tube to be inserted and/or removed from between gun base 260 and nozzle body 280 without disconnecting these latter components from high pressure water tube 278. For this purpose, the length of counter bore 292 is preferably more than twice the projecting length of the threaded nipple end 295.

Figure 7:
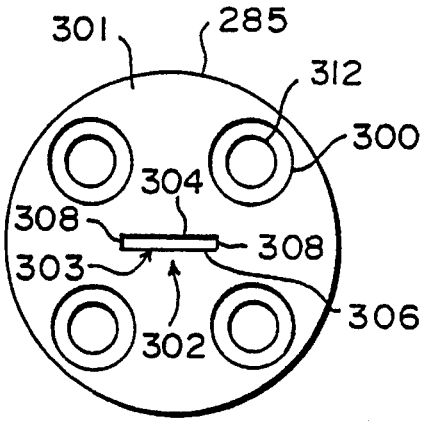
FIG. 7 is a front elevational view of the nozzle cap shown in FIG. 5.
Figure 8:
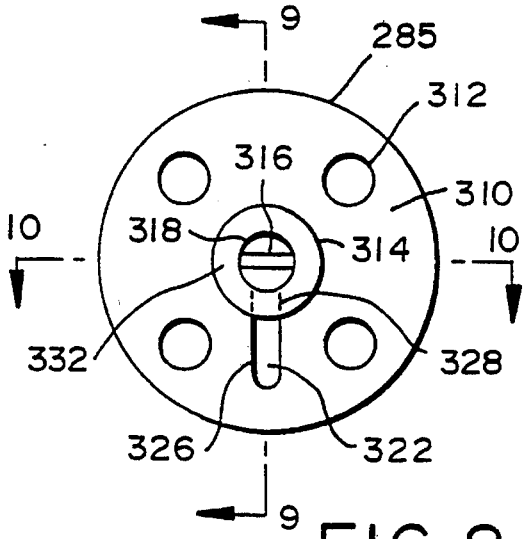
FIG. 8 is a rear elevational view of the nozzle cap shown in FIG. 5.

Referring now to FIGS. 7–10, there is shown in greater detail the nozzle cap 285 of the invention. FIG. 7 depicts the front or free end of the nozzle cap which has counterbores 300 for heads of the four bolts (not shown) which secure cap 285 to nozzle head 280. Also shown is the outlet opening 303 of a fan-spray discharge slot 302 which has an upper wall 304, a lower wall 306, and a pair of opposing sidewalls 308, 308. In FIG. 8, there is shown the rear or internal face 310 of cap 285, which along with front cap face 301 is penetrated by bolt holes 312. Also shown in this view is a rearwardly projecting cap nipple 314 having a rear surface 332 framing a rear opening 316 of slot 302. As evident from FIGS. 7 and 8, slot 302 has a generally flat rectangular shape and the side walls thereof diverge outwardly from rear opening 316 to front opening 303. Preferably, the side walls 308, 308 diverge uniformly from rear opening 316 to front opening 303, and the upper and lower walls thereof are spaced at a uniform distance apart, which may be seen best in FIGS. 9 and 10.

Nipple 314 defines an entrance opening 318 for an impact and mixing chamber 320 into which media is fed by means of a radial channel 322 and a media orifice 324. The forward and side walls of an outer portion of media channel 322 are formed by a groove 326 in the rear face 310 of cap 285. The rear wall of radial channel 322 is formed by a corresponding part of the front face of nozzle head 280 as may be seen in FIG. 12. By way of example, the diameter of nozzle cap 285 may be about 1.73", and the height of the slot 302 may be about 0.07". As indicated by the difference (0.0126") in the radial distances D1 and D2 in FIG. 9, the center of the slot 302 is preferably offset from the center of mixing chamber 320 for reasons explained hereinafter. By way of further example, the width of rear slot opening 316 and the diameter of chamber 320 may be about 0.304", the width of slot front opening 303 may be about 0,512", and the length of slot 302 may be about 0.847", for a orifice size providing a fan spray with an angle of divergence AD from side-to-side of nominally about 15°. The rear slot opening 316 is cut into the forward wall 330 of mixing chamber 320.

Figure 11:
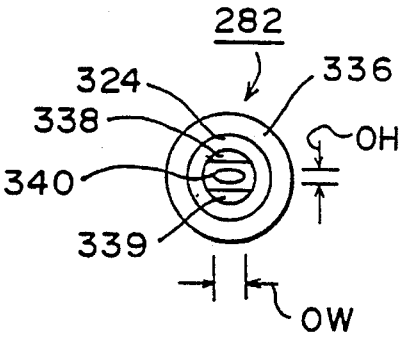
FIG. 11 is a front view of the nozzle tip shown in FIG. 5.

The rear face 332 of nipple 314 on the rear face of nozzle cap 285 is sized to rest against a corresponding forward face 334 of nozzle tip 282 shown in FIG. 11. Nozzle tip 282 also has a base 336, upper and lower spray guide ridges 338 and 339, respectively, an orifice 340 having an oval or football-like shape, preferably with a height OH along the minor axis of about 0.015" and a width OW along its major axis of about 0.030".

The orifice opening is preferably oval in shape to provide a flat fan spray pattern that has a transverse width dimension substantially larger than a transverse height dimension. This pattern is preferred where the surface to be cleaned is fragile or the coating is only moderately hard. The minor dimension (height) of an oval nozzle orifice may be between about 0.005 inches (") and about 0.018", and its major dimension may be between about 0.014" and about 0.041", depending on the particular application and for pressures between about 5,000 psig and about 36,000 psig and for liquid flows between about 0.33 gpm and about 10.0 gpm. Round orifice openings, such as those described in U.S. Pat. No. 5,220,935, may be preferable for some applications, such as for rotating nozzle heads or where the coating is very hard and the underlying surface is not particularly fragile.

The nozzle tip 282 may be made of tungsten carbide or sapphire. Filtering the cleaning liquid through a 0.5 micron filter allows the use of a tungsten carbide nozzle tip at the pressures used by the present invention with significantly increased service life.

Figure 12:
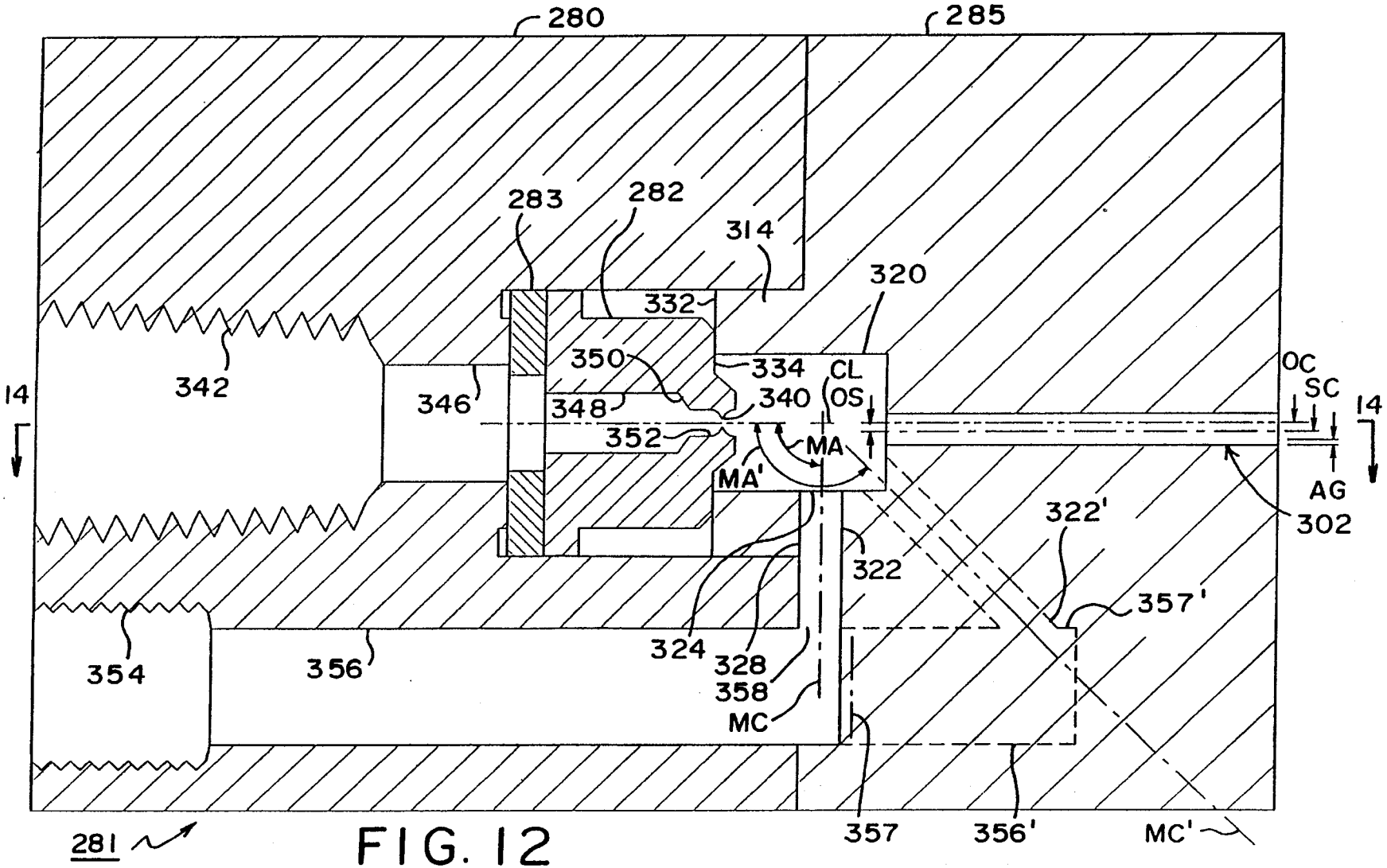
FIG. 12 is an elevational view in section of the nozzle head, the nozzle gasket, the nozzle tip and the nozzle cap of FIG. 5 shown in their assembled positions.

Referring now to FIG. 12, there is shown in elevation a section of nozzle body 280 and nozzle cap 285 to illustrate the assembly therein of nozzle tip 282 and nozzle gasket 283. The inner portion of channel 322 penetrates the base of cap nipple 314 to form a transverse passage 328. Nozzle head 280 has a threaded passage 342 for receiving the threaded end 344 of water tube 278, a water bore 346 of uniform diameter leading to a orifice bore 348 having stepped tapers 350 and 352 leading to orifice 340.

Nozzle head 280 has a second threaded passage 354 for receiving the threaded nipple 295 of the forward media tube socket 297. Passage 354 leads to a media bore 356 of uniform diameter, which in turn leads to the radial media channel 322 having an outlet orifice 324 as previously described. Both the inlet opening 358 and the outlet orifice 324 of media channel 322 have a cross-sectional area substantially less than the cross-sectional area of the media bore 356 in order to accelerate the media particles to the higher velocities needed to penetrate the fan spray ejected by water orifice 340 as described more fully hereinafter. Bore 356 may have a short extension to form a pocket 357 which serves to collect a cushion of media grit for turning the media flow while minimizing potential wear at the end of bore 356. A similar pocket indicated by broken line 357' may be provided at the end of an optional bore extension 356'.

As described further below, the media incidence angle MA defined by the media axis, which corresponds to the media channel centerline MC, may vary from about 60° to about 150°, preferably at least about 80°, more preferably about 80° to about 135°, and most preferably about 90° to about 105° or about 115°. In FIG. 12, incidence angle MA is shown to be about 90°, and there is also shown the optional extension 356' of media bore 356 to provide an optional media channel 322' having a centerline MC' at a position giving an incidence angle MA' of about 135°. As illustrated by the perpendicular sectional views of FIGS. 12 and 14, the media axes corresponding to centerlines MC and MC' are preferably in a plane substantially perpendicular to the plane containing the fan width dimension FW, which is discussed further below in connection with FIG. 14.

Figure 9:
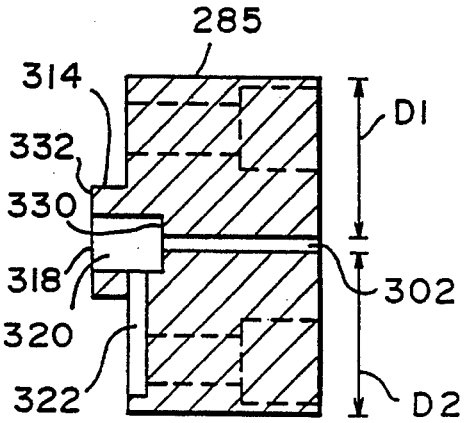
FIG. 9 is a sectional view of the nozzle cap taken along line 9—9 of FIG. 8.
Figure 10:
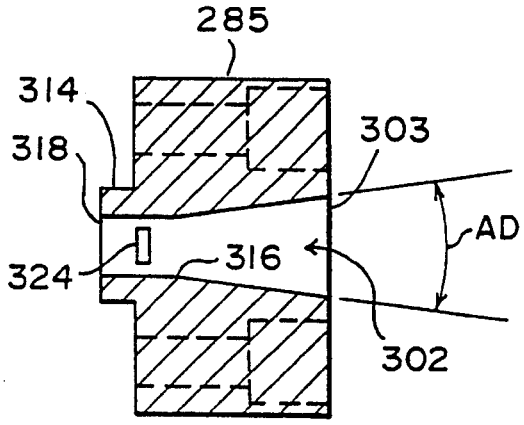
FIG. 10 is a sectional view of the nozzle cap taken along 10—10 of FIG. 8.

As previously described with respect FIG. 9, the centerline SC of slot 302 is preferably offset from the centerline CL of impact chamber 320, which provides an equal offset OS from the water orifice centerline OC. The purpose of the offset OS is to provide an air gap AG to let an air flow 364 separated from the media particles P escape through slot 302 without mixing with the water and media particle stream, which thereby eliminates or greatly reduces the atomization of the water with this air. Such atomization is undesirable because to the extent that a quantity of water is atomized by the escaping air, this amount of water is substantially reduced in velocity and thereby deprived of its effectiveness as a cleaning agent.

Figure 13:
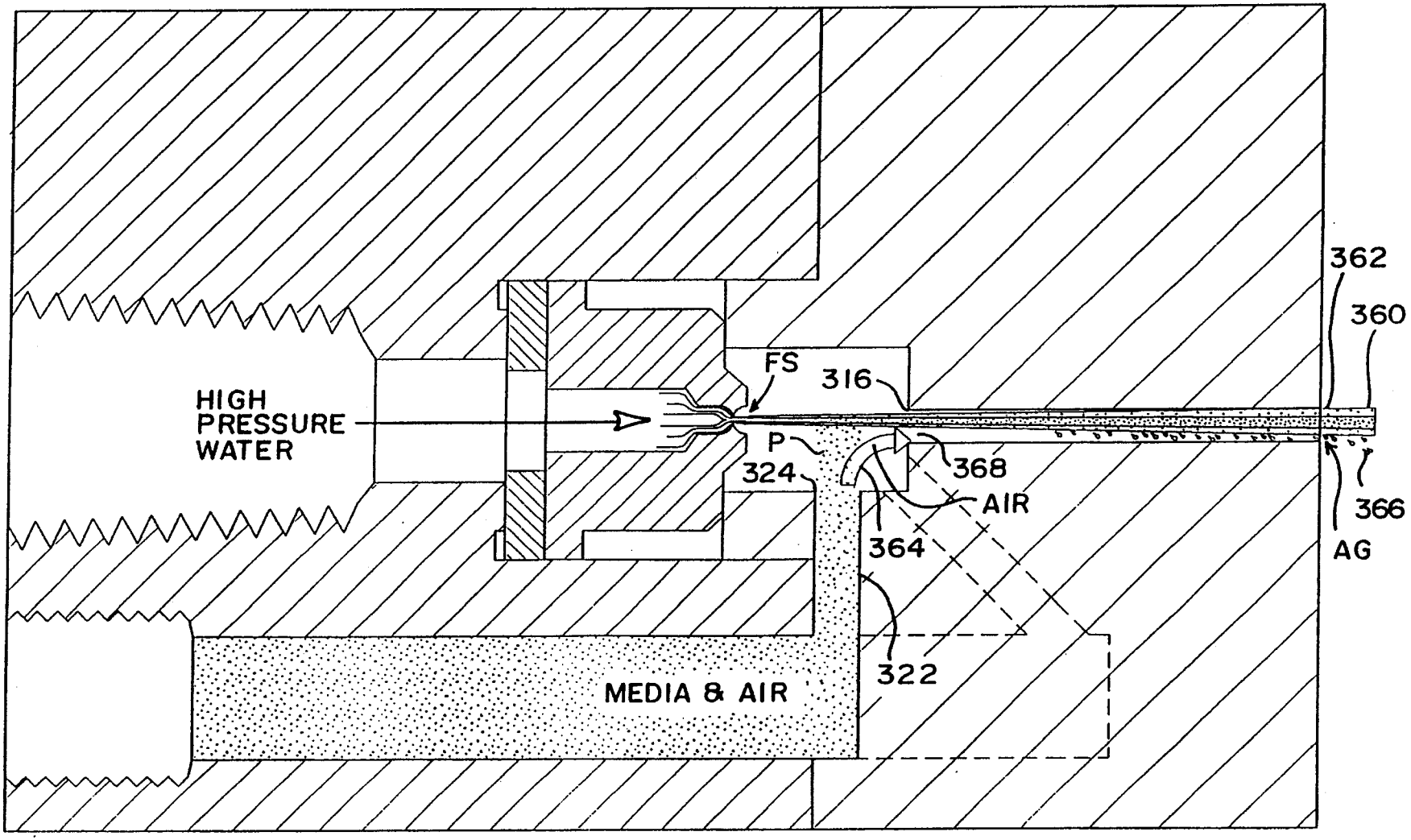
FIG. 13 is the same sectional view as FIG. 12 illustrating the elevational flow patterns of the water, media and the media transport gas as they converge together and exit through the fan spray slot in the nozzle cap.

The purpose of the steep incidence angle MA, or alternatively the reverse incidence angle MA', is to cause the light abrasive particles to penetrate into the inner core 360 and the outer core 362 of the fan spray FS ejected by nozzle orifice 340 as illustrated diagrammatically in FIG. 13. Also shown diagrammatically in this figure is the air gap 368, AG, which provides a path of least resistance for the escape of air flow 364 and is provided by the nozzle orifice centerline to slot centerline offset OS described above in connection with FIG. 12. Air flow 364 is produced by the pressure and volumetric flow rate of the grit transport air, and these parameters are preferably of sufficient magnitude to provide a positive pressure of greater than one atmosphere in impact chamber 320. The relatively high velocity of air flow 364 through air gap AG may cause sufficient turbulence to release small droplets of water from outer core 362 in the form of a mist 366. However, the provision of air gap AG is an important feature of the invention in that it greatly conserves the kinetic energy of inner core 360 and outer core 362 by minimizing the amount of water transferred from these cores to mist 366.

The invention also contemplates that the inner and outer cores of fan spray FS may be approximately centered within the height of slot 302 so as to provide an air gap AG both above and below the fan spray so as to provide two paths of least resistance for the air after it separates from the abrasive particles; however, this embodiment is less preferred because it approximately doubles the surface area of the outer core 362 exposed to the relatively high velocity air 364.

As previously indicated, the cross-sectional area of radial media channel 322 is sized to significantly accelerate the media particles so that they impact the fan spray FS at a velocity sufficient to penetrate into both the inner core 360 and the outer core 362. Since even light media particles are substantially heavier than air, the media particles P continue on a substantially straight path while the air 364 turns through the angle necessary to enter the air gap portion 368 of slot entrance opening 316 (FIG. 13).

Figure 14:
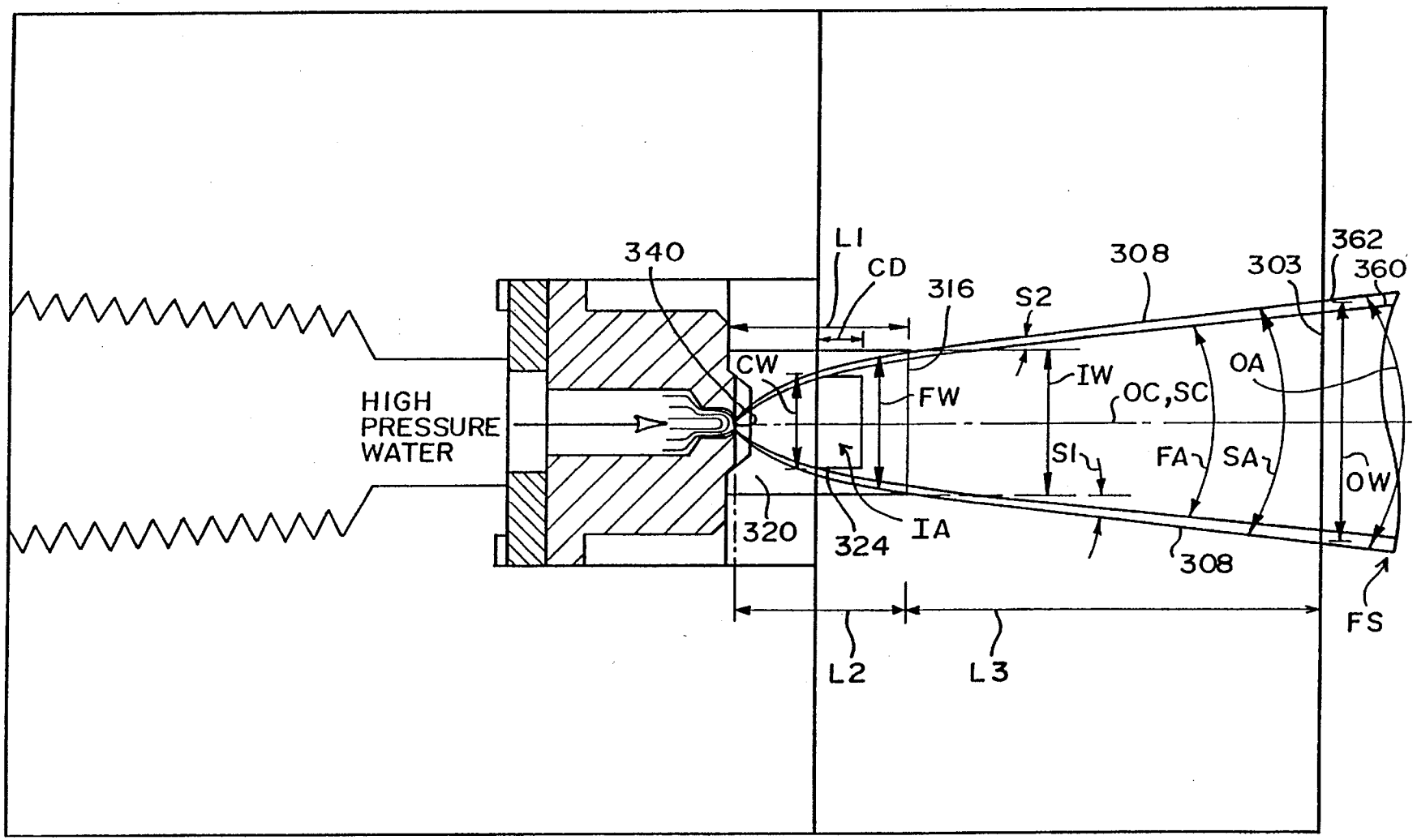
FIG. 14 is a sectional view of the nozzle head components taken along line 14—14 of FIG. 12.

While FIG. 13 illustrates the pattern of fan spray FS in elevation from one side, FIG. 14 illustrates the fan pattern of fan spray FS in plan, that is, viewing the fan spray from above in a direction perpendicular to the plane of the fan-shaped spray as defined by its major axis which extends in the direction of the slot width, such as its inlet width IW and its outlet width EW. The angle at which each slot sidewall 308 diverges from slot entrance 316 to slot outlet 303 is represented by the sidewall angles S1 and S2, which are preferably selected to match the corresponding angle of divergence of each side of the fan spray FS. Thus, where nozzle tip orifice 340 is a 7° orifice, each of the sidewall angles S1 and S2 also is preferably 7°. It is also important to recognize that a 7° water nozzle orifice diverges 7° to either side of the orifice centerline OC such that an overall slot angle SA and an overall spray angle OA, which extend from sidewall to sidewall, are each a corresponding 14°. The overall angle OA of the spray and the overall slot angle SA may vary from about 5° to about 25°, preferably about 7° to about 15°.

As previously explained, it is important that the media stream exit media opening or orifice 324 with sufficient velocity to penetrate into the inner core 360 of the fan spray FS. The media channel 322 and the orifice 324 are sized to achieve a media velocity of at least about 200 feet per second, preferably about 200 to about 800 feet per second, more preferably about 400 to about 600 feet per second, most preferably about 500 feet per second. It is also important that the media orifice width CW correspond approximately to, or be slightly less than, the width FW of the fan spray FS over the impact area IA, which corresponds approximately to the area of the media orifice 324 as determined by its width CW and its depth CD as illustrated in FIG. 14. The width of the spray pattern is designated FW and this width constantly increases after the spray leaves orifice 340. By way of example, the depth L1 of the mixing chamber 320 may be 0.37", the distance L2 between orifice 340 and forward mixing chamber wall 330 may be 0.352", and the diverging slot length L3 may be 0.847". The corresponding slot inlet width IW may be 0.304" and the corresponding outlet slot width EW may be 0.512".

As evident from the foregoing, the width CW of the media orifice is chosen to approximately match the width FW of the fan spray FS over the area IA over which the media particles impact the fan spray pattern in impact and mixing chamber 320. The media channel width is first selected to provide this coverage. The media channel depth is then chosen such that its cross-sectional area relative to the cross-sectional area of media feed bore 356 is such that the media particles achieve the desired velocities indicated above. By way of example, for a 7° nozzle orifice, the media bore 356 is 0.25" in diameter, the media channel width CW is about 0.2", and the media channel depth CD is about 0.12". For a 15° nozzle, the media feed bore 356 has the same diameter, but the channel width CW changes to 0.25" and the channel depth CD changes to 0.092".

The reasons for accelerating the media particles (grit) through the channel 322 and for providing a steep angle between the centerline MC of this channel and the plane of the fan spray FS may be summarized as follows. The grit is accelerated into the range of 200 to 800 feet per second to keep it from bouncing off of the water stream because this water stream presents a relatively hard surface in close proximity to its discharge from a high pressure orifice, the inner core 360 being substantially harder than the outer core 362. The velocity actually chosen depends on the pressure and the flow rate through the orifice. The objective is to give the grit sufficient velocity to have a substantial portion thereof pass through the outer core 362 of slower moving water and penetrate into the inner core 360 of fastest moving water.

On the other hand, there are practical limits on the flow rate of the water stream. Flow rates greater than 25 gallons a minute through a single nozzle require high pressure pumps of excessively high horsepower. Also, 25 gallons per minute is about the maximum flow in a fan spray into which light weight grit can be made to effectively penetrate the inner core. Furthermore, flow rates in excess of 10 gallons per minute can not be held by hand as a practical matter because of the excessive reaction force generated by the ejection of higher flow rates of water. Thus, flow rates of about 10 gallons per minute or less are best for achieving sufficient penetration of light weight grit into the inner core of the fan spray and for manipulating the corresponding spray gun by hand. The best compromise for both spray penetration by the grit and a portable pump motor of about 25 horsepower is a flow rate of about 3 to 4 gallons per minute.

In a preferred embodiment using a light weight grit, such as baking soda, and a 7° water orifice, a 25 horsepower pump delivers 3.2 gallons per minute at a pressure of 15,000 psig. For this fan spray, it is best to angle the grit toward the plane of the water spray at a media angle MA in the range of 45° to 145° because angling the grit at less than 45° relative to the direction the water of the fan spray is moving takes substantially higher grit velocities to prevent the grit from bouncing off the water stream. Media angles in the range of 80° to 135° permit lower grit velocities and thereby further conserve the energy necessary for propelling the grit. Although media angles greater than 90° and up to 145° are believed to require lower grit velocities for effective penetration of the inner spray core, it was found to be easier to manufacture the media channel 322 at a media angle of about 90°. Although media angles of 90° or greater are preferred, media angles of 45° to 90° may be used by increasing the grit velocity to a level sufficient to have the light weight grit penetrate the inner spray core at these media angles.

Tests have also shown that it is best not to have a turning radius at the transition between media bore 356 and media channel 322, but instead have the media make a sharp turn of at least about 90° because the latter arrangement provides a more even grit distribution throughout the area bounded by the rectangular shape of the media orifice 324. Another important consideration is that the slot 302 in the nozzle cap should conform to the shape of the fan spray leaving the water orifice 340. In other words, if the orifice provides a spray on each side of its centerline, the sides of the slot 302 should conform to this angle. It has also been found that angling the grit inward toward the direction the fan spray is moving takes a higher grit velocity for effective inner core penetration than if the grit impact is angled inward toward the direction the fan spray is coming from, such as along centerline MC' in FIG. 12.

If the water spray angle FA of the inner core 360 is greater than the slot angle SA, the fan spray pattern at the outlet slot opening 303 may have two opposite fingers of heavy grit adjacent to each of the slot sides 308. If the fan spray angle FA is less than the cap slot angle SA, the transport gas is provided with additional exit paths of least resistance along each edge of the fan spray pattern and these additional exit paths cause corresponding atomization along the edges of the fan spray. This atomized water and grit reduces the cleaning efficiency of the fan spray after it leaves the cap slot. It is therefore preferred to provide a single, relatively uniform path of least resistance beneath the lower flat face of the fan spray.

The velocity of the grit is such that its kinetic energy is sufficient for the grit particles to pass through the outer slower moving core of the water spray and penetrate into the fastest moving inner core of the water spray. Since the grit and the gas leave the media orifice 324 at about the same speed and the grit is heavier than the gas, the kinetic energy of the grit is substantially greater than that of the gas. Therefore, the grit P travels in a substantially straight line while the air 364 turns and exits from the impact chamber 320 through the air gap 368, AG, which provides the path of least resistance and along which the air escapes to minimize atomization of the water.

In other words, the transport gas flows through the slot adjacent to the underside of the outer core of the water spray. In order to provide the air gap path of least resistance for the air, the cap slot 302 is offset toward the side of mixing chamber 320 containing the media orifice 324 as showing in FIGS. 12 and 13. By reason of this offset, the upper flat face of the fan spray's outer core travels along the upper wall 304 of the cap slot. On the opposite side of the water spray, the lower flat face thereof is spaced a corresponding vertical distance away from the lower wall 306 of the cap slot 302, thus providing the air gap path of least resistance for the media transport gas to escape from the impact chamber 320. The air gap height as so provided between the fan spray outer core and the lower slot wall 306 will depend on the flow rate of the transport gas being used, i.e., the height of the air gap needed will increase as the gas flow rate increases.

The incidence angle MA of the abrasive particles relative to the liquid spray axis OC and the velocity of the particles are sufficient for at least a substantial portion of the particles to penetrate into and be propelled by the inner spray core 360 which remains substantially free of the transport gas (air) and of any other gases in mixing chamber 320. The inner core contains the highest velocity water ejected by the water orifice. The inner core velocity is believed to be greater than about 700 ft/sec, preferably about 800 to about 2,000 ft/sec, more preferably about 900 to about 1,700 ft/sec, and most preferably about 1,200 to about 1,500 ft/sec.

Because of the short residence time of the penetrating particles within the spray before it impacts the surface being cleaned, these particles achieve a forward velocity less than that of the inner core. However, it is believed that the abrasive particles in the present invention achieve at least 65% to 75% of the inner water core velocity. Accordingly, the particle velocity is believed to be at least about 450 ft/sec, preferably about 500 to about 1,500 ft/sec, more preferably about 600 to about 1,300 ft/sec, and most preferably about 800 to about 1,100 ft/sec.

The axis OC (orifice centerline) of the liquid spray from the nozzle head is preferably directed to the surface to be cleaned at an acute angle, which is relative to its plane if it is a generally flat surface or to a tangent plane if it is a curved surface. This acute angle is between about 20° and about 90°, preferably about 35° to about 75°, more preferably about 55° to about 65°, and most preferably about 60°.

Motor-Actuated Spinning Head Nozzle Assembly

Figure 15:
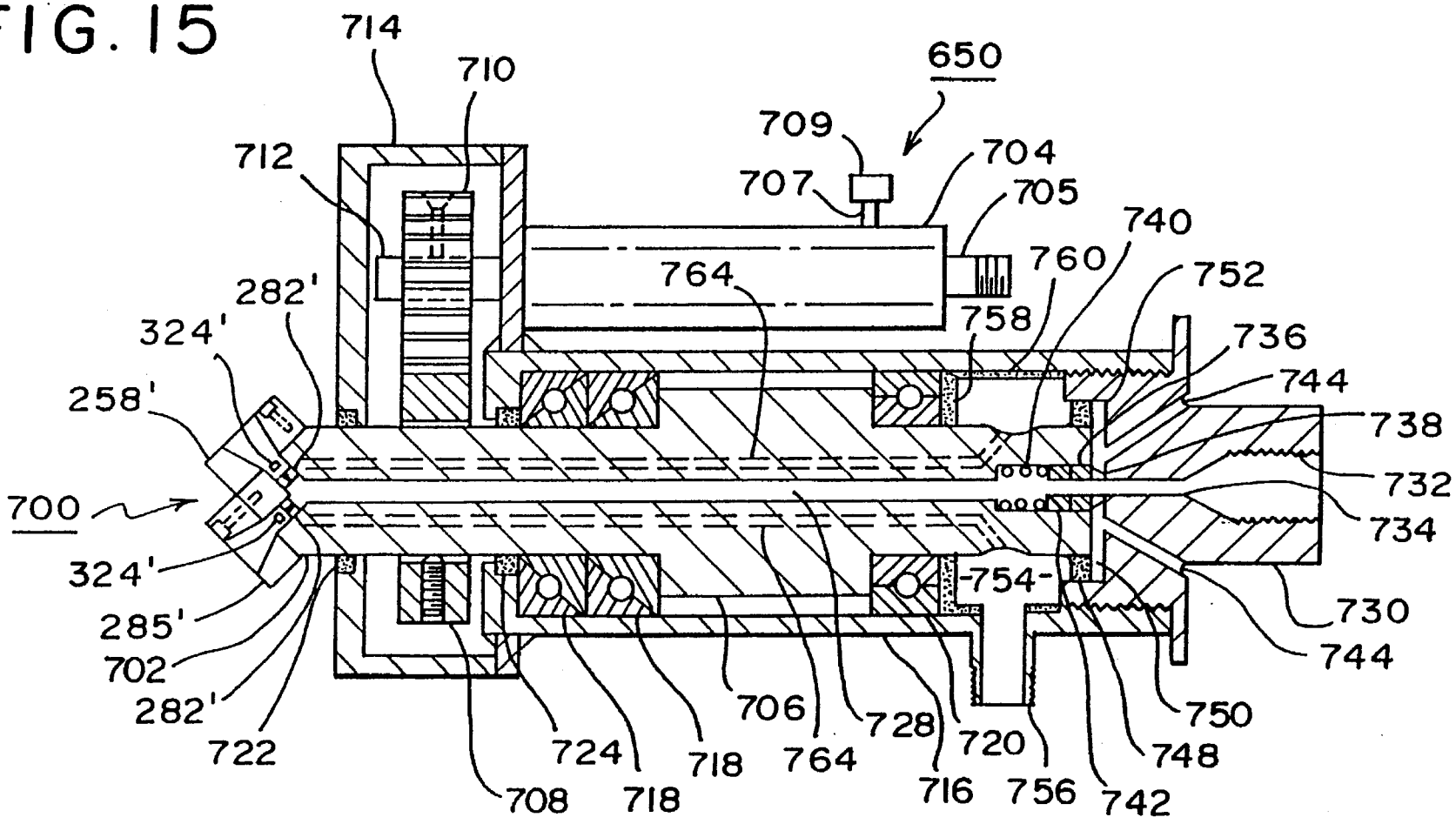
FIG. 15 is a sectional view of a motorized spinning head nozzle in accordance with a modification of the invention.

Referring now to FIG. 15, there is shown a motor actuated nozzle assembly 650 having a spinning head 700 on which are mounted a pair of nozzle caps 285', 285', the internal structure of which is the same as the nozzle cap 285 of FIGS. 12–14. In this embodiment, two internal structures equivalent to that of nozzle head 280 of FIGS. 12–14 are incorporated integrally in a forward portion 702 of a rotary shaft 706. These internal structures include a pair of media orifices 324', 324' and a pair of nozzle tips 282', 282'. For clarity of illustration, the nozzle caps 285'285', are shown with an orientation such that the major plane of the fan-shaped slot coincides with the spin axis of shaft 706. A 90° change in the orientation of nozzle caps 285', 285' and of corresponding nozzle tips 282', 282' relative to the forward end of shaft 706 may provide a more narrow annular band of fan spray impact as head 700 rotates.

Mounted at the forward portion 702 of shaft 706 behind the nozzle caps 285', 285' is a driven gear 708 which is engaged by a driving gear 710 mounted on a drive shaft 712 of an air motor 704 having an air inlet 705 and an air outlet 707 with an air muffler 709. Gears 708 and 710 are surrounded by a gear housing enclosure 714 which may contain an oil lubricant and on which is mounted the forward end of air motor 704.

In turn, housing 714 is mounted on a cylindrical casing 716 which houses a pair of angular contact thrust bearings 718, 718 and a radial ball bearing 720 in which shaft 706 is rotatably mounted. An oil seal 722 bearing against shaft 706 is mounted in an abutting forward wall of housing 714 and an oil seal 724 is mounted in an abutting forward wall of cylindrical casing 716. Alternatively, seals 722 and 724 may be merely dirt seals where no lubricant is required in gear housing 714 because of the materials selected for these gears, such as making the driven gear 708 out of metal and the driving gear 710 out of a self lubricating, commercially available phenolic material.

High pressure water is provided to the respective bores in which nozzle tips 282', 282' are mounted by a central high pressure water passage 728 which is connected to a source of high pressure water through a rear end cap 730 having a threaded bore 732 tapered into an inlet water bore 734 which passes through a non-rotating throat bushing 736 preferably made of a beryllium and copper alloy capable of providing a metal to metal seal with face 738 of rear cap 730 under the spring force of a compression spring 740. Between compression spring 740 and non-rotating bushing 736 is a rotating seal 742 preferably made of VESPAL, a registered trademark of the Du Pont Company for one of its highly wear resistant polyimide resins. Since some leakage between bushing 736 and the inner face 738 of end cap 730 may be expected, a pair of weep passages 744, 744 is provided in rear end cap 730. Surrounding the rear end of shaft 706 is a conventional double lipped water seal 748 which is press fitted into an inner cavity 752 of rear end cap 730. Water seal 748 is of conventional design and has spring loaded lips, one facing a weep water chamber 752 at the base of cavity 752 and the other facing a media chamber 754 fed by media line 229 (FIG. 1) connected to an inlet nipple 756. The forward end of media chamber 754 is provided with a grit seal 758 and the outer perimeter of media chamber 754 is covered with a synthetic rubber or plastic coating 760 to protect the adjacent inner surface of casing 716 from abrasive wear which might otherwise be caused by the flow of air and abrasive particles (media) through media chamber 754. The media entering chamber 754 is fed to a pair of passages 764, 764 extending longitudinally through shaft 706 and parallel to its rotational axis. The media passages 764, 764 perform the same function as media bore 356 of FIG. 12 and the forward ends thereof feed the media to media channels (not shown), which correspond to media channel 322 of FIG. 12 and end at media orifices 324', 324'.

Motor 704 also may be a three-quarter horsepower D/C motor of the variable speed type capable of up to 2,000 rpm. Whether air or electric powered, water nozzle motor 704 may be of the type which may rotate in either direction. This is desirable for the lateral positioning of a pair of these nozzles as mirror images of each other on opposite sides of a workpiece passing therebetween because in such an arrangement, it is preferably that the spinning heads of the respective assemblies rotate in opposite directions so that the debris from the removed coating is effectively blown in the same direction.

The nozzle caps 285', 285' and the related structures at the shaft head 700 may be replaced by the venturi nozzle structure of FIG. 16 described below. In this arrangement, media passages 764 feed into a media distribution chamber in head 700 similar to chamber 815 in FIG. 16.

Venturi Blast Nozzle Assembly

Figure 16:
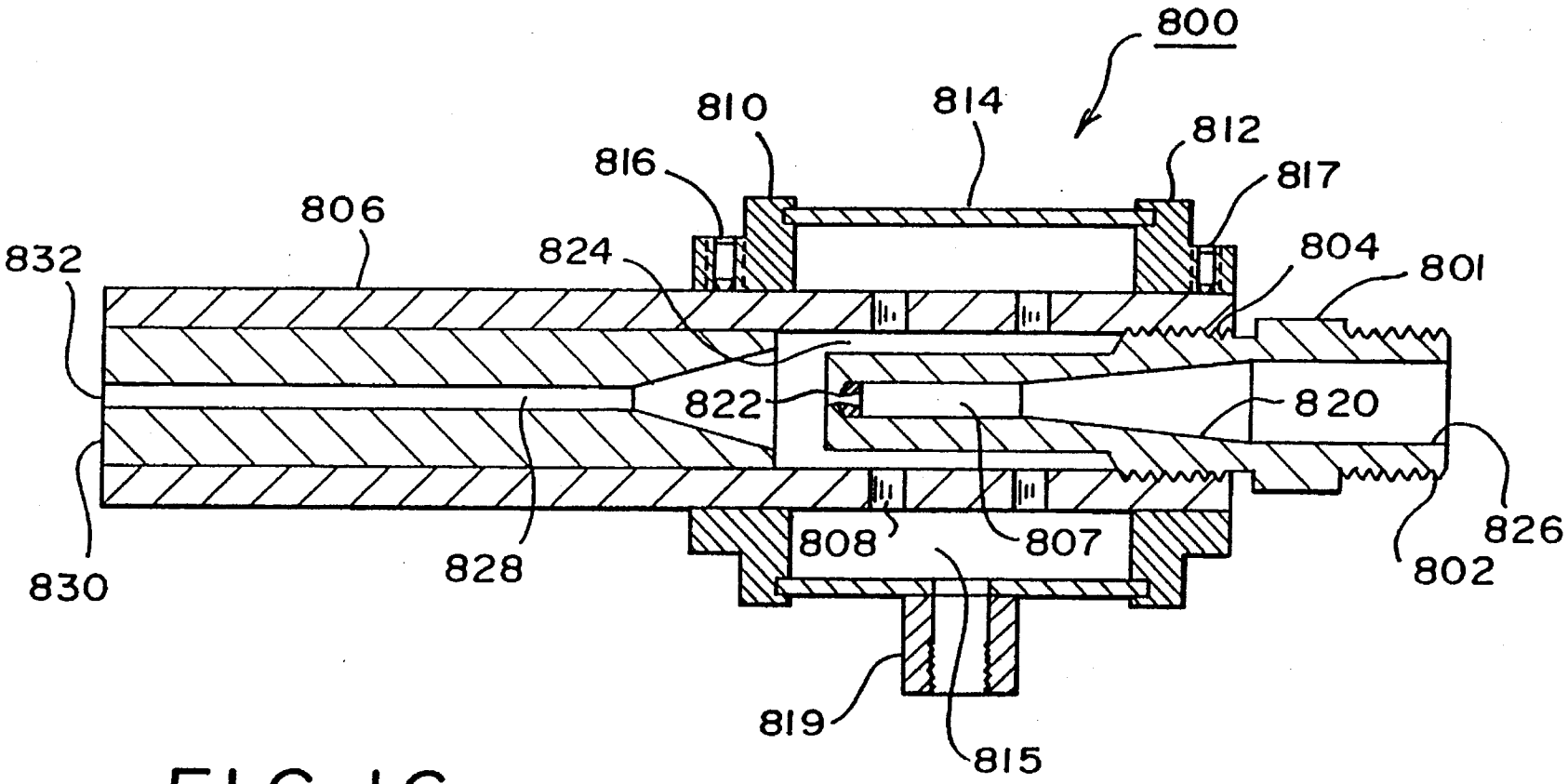
FIG. 16 is a sectional view of a relatively lower flow venturi nozzle in accordance with another modification of the invention.

Referring now to FIG. 16, there are shown the details of a venturi blast nozzle, generally designated 800, for removing more loosely adhered deposits and/or moderately hard coatings that are less hard than metal scale or paint, such as the grim, mold and/or dirt that sometimes accumulates on the surfaces of the narrow runs of grout between the rectangular ceramic tiles of a tile floor such as found in bathrooms, kitchens and the like. Blast nozzle 800 comprises a water nozzle body 801 which may be connected by threads 802 to the threaded coupling 234 at the end of high pressure water hose 237 (FIG. 1). Nozzle body 801 is secured by threads 804 to a cylindrical barrel 806 having a diameter larger than a carbide insert 830 at the discharge end thereof and lateral media passages 808 leading from a media chamber 815. Media passages 808 are surrounded by a cylindrical body 814, one end of which is secured to barrel 806 by an annular disk 810 having a set screw 816, and the other end of which is secured to barrel 806 by an annular disk 812 having a set screw 817. Cylindrical body 814 and annular disks 810 and 812 define the media chamber 815 which receives media via a nipple 819 which is wedded to body 814 at one end and at the other end are threads 821 for connecting nipple 819 to the media hose 229 (FIG. 1).

Nozzle body 801 has a tapered bore 820 upstream of a straight bore 807 and these bores focus the high pressure water entering nozzle body 801 through inlet passage 826 and guide this water to a nozzle tip 822 having a round orifice of the focused type. The nozzle tip 822 is made in accordance with the water focusing principles in U.S. Pat. No. 5,220,935, and any of the focused tips described in that earlier patent may be used as the tip 822. These focused tips also may be used in place of the fan spray tip 282 of FIG. 11, although this arrangement is less preferred because the insertion area IA is much smaller for a round spray than for the fan spray illustrated in FIG. 14. In this arrangement, it may be desirable to also use a carbide insert, similar to the cylindrical bore insert 830 of FIG. 16, but sized and shaped to provide slot 302, because it is likely that fewer particles will penetrate into the inner core of spray FS.

The water stream, which leaves nozzle tip 822 at high velocity, creates a strong suction force in the chamber annulus 824 and this suction force sucks through lateral passage 808 a relatively high flow rate of media grit, such as 2 to 3 #/m or more, into cylindrical discharge passage 828. The flow of media grit admixed with water and transport gas is then discharged from barrel insert opening 832 and against the workpiece, whereupon the discharged water, gas and grit mixture dislodges and blows away the coating or accumulated deposits.

In many cleaning applications, the venturi water nozzle of the invention may be used to remove moderately adhered and/or moderately hard coatings or deposits on a substrate. Even when this abrasion cleaning assembly utilizes water flow rates in the low range of about 0.3 to about 1.5 gpm, preferably about 0.5 to about 1.0 gpm, it may still replace many mechanical abrasion or impact systems of the prior art.

In many instances, this assembly may be preferred over higher flow operation using the water and media nozzles of FIGS. 7–15 because the venturi nozzle involves a reduced number of components and a simplified arrangement thereof, may be less expensive to assemble and operate, and may make it easier to maintain a dry environment upstream of the media orifice. However, the venturi nozzle is less effective per unit of energy expended because the grit particles do not penetrate into the inner spray core and, although some particles may enter the outer spray core, these particles do not achieve a velocity approaching that of even the slower outer water core.

A Method And Apparatus For Removing Resinous Coatings

Figure 17:
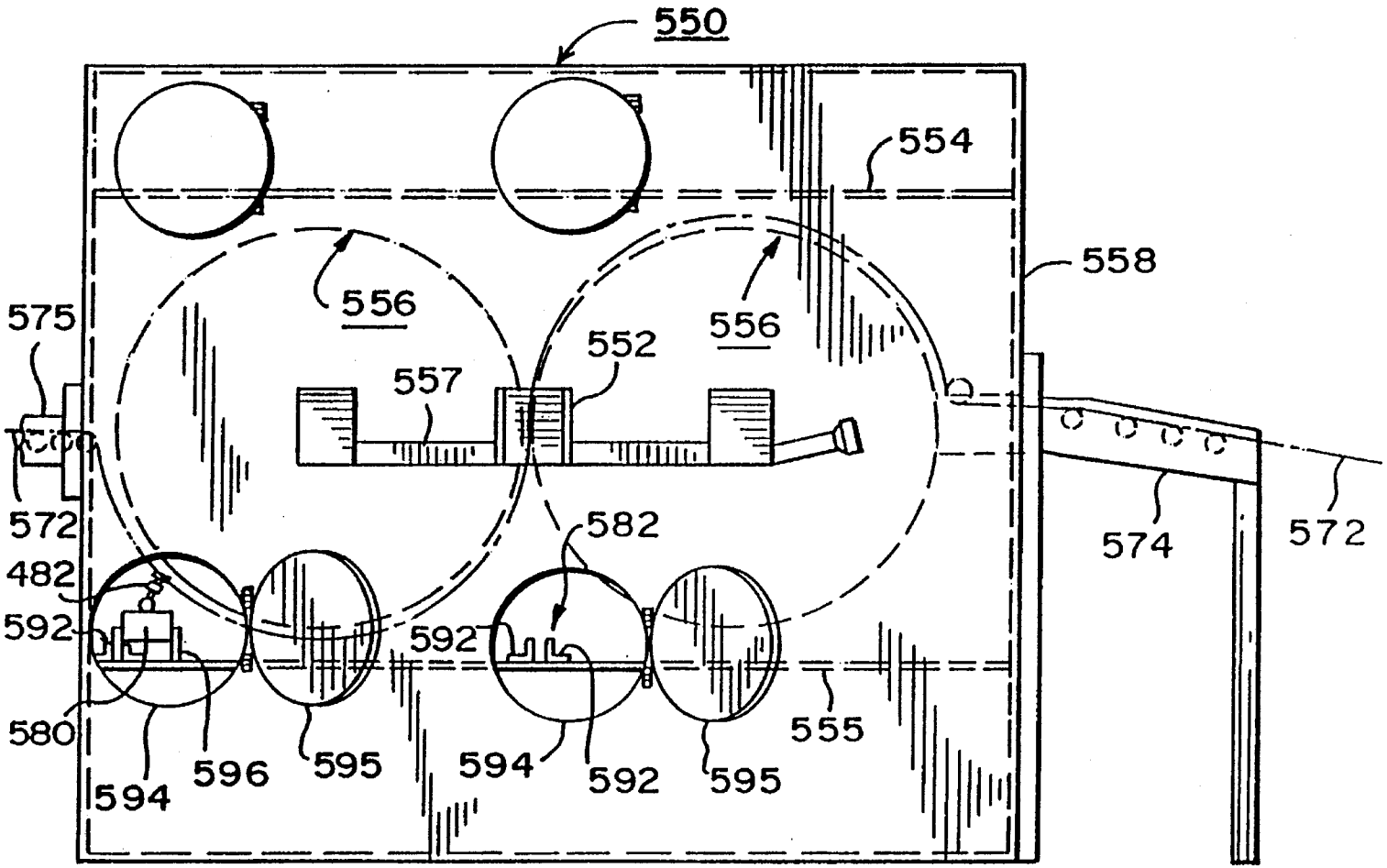
FIG. 17 is a front elevational view of a drying machine illustrating diagrammatically a modification of the invention as used for cleaning resin-impregnated fibrous material from a perforated drum thereof.
Figure 18:
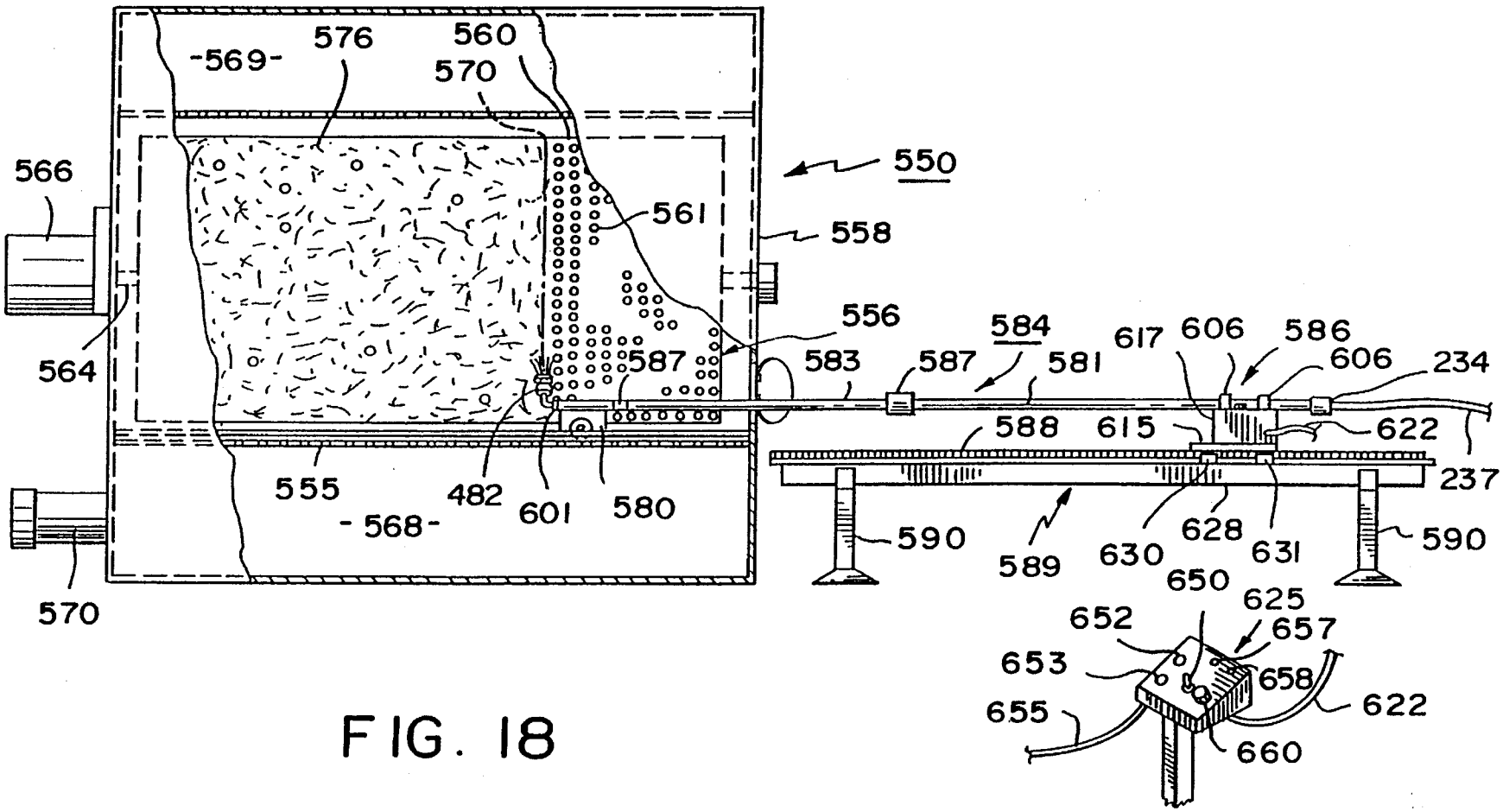
FIG. 18 is a side elevational view in partial section of the modification of the invention shown in FIG. 17.

The invention also is effective and efficient in removing dried resinous coatings from metal surfaces, such as in cleaning operations for removing dried resin-impregnated fibrous material from perforated steel drums and calendar rolls in dryers manufactured by Fleissner, Inc., of Germany. One such dryer, generally designated 550, is illustrated diagrammatically in FIGS. 17 and 18. One or more fans 552 suck heated air first through perforated upper and lower baffle sheets 554 and 555, respectively, then through a pair of perforated drums 556,556, and then through duck work 557 positioned in the interior of the drums as shown in FIG. 17. Each drum 556 has a perforated cylindrical wall 560 with a plurality of small openings 561 and is mounted for rotation on a shaft 564, which in turn is rotatably mounted in a drum housing 558 and driven by a variable speed motor 566 as shown in FIG. 18. Heated air is provided to lower and upper air distribution chambers 568 and 569, respectively, by a gas burner 570.

A web 572 (FIG. 17) of fleece comprising resin-impregnated fibers is fed into housing 558 by a conveyor 574, where the fleece web passes around a portion of each of the perforated drums 556,556 and then exits the housing 558 on a second conveyor 575. The resin of the entering fleece web is uncured and the fleece web is heated to dry and cure the resin as it passes around the drums 556,556. Because both the fleece and the drum perforations offer resistance to the hot air being sucked into the drums from the distribution chambers 568 and 569, there is a partial vacuum in the interior of the drums and this differential pressure pulls the fleece web against the surface of the drums as they rotate. The suction also results in an accumulation over time of a layer of cured resin and fibers which strongly adhere to the surface of the drum as a coating 576.

Over an extended period of dryer operation, the coating 576 (FIG. 18) builds up sufficiently to cause a significant decrease in the efficiency of the fleece drying and curing operation. When this occurs, the dryer 550 must be removed from operation and the coating 576 removed from both the drum surface 560 and from within the plurality of drum openings 561. The present invention provides an effective, efficient and economical method for removing the coating 576 from the drums 556,556.

A cart 580 carries one of the water and media nozzles of the invention, such as the fixed body and cap assembly 281, or the spinning nozzle assembly 650. Cart 580 is propelled along a track 582 mounted in the dryer by a conduit assembly 584 driven by a trolley, generally designated 586, which engages a rack 588 mounted on an exterior track assembly 589 having a pair of supporting stands 590,590. The track 582 for nozzle cart 580 is preferably provided by a pair of opposing angle irons 592,592 which are mounted on lower baffle plate 555 of the dryer through dryer access openings 594,594, which are closed by swinging doors 595,595 when dryer 550 is in operation. Angle irons 592,592 are preferably bolted at two or more locations along their length to lower baffle plate 555. As shown best in FIGS. 17 and 20, the space between angle irons 592,592 receives one of the pair of cart wheels 596,596 to guide nozzle 482 in spaced relation at a fixed distance from the surface 560 of drum 556.

Figure 19:
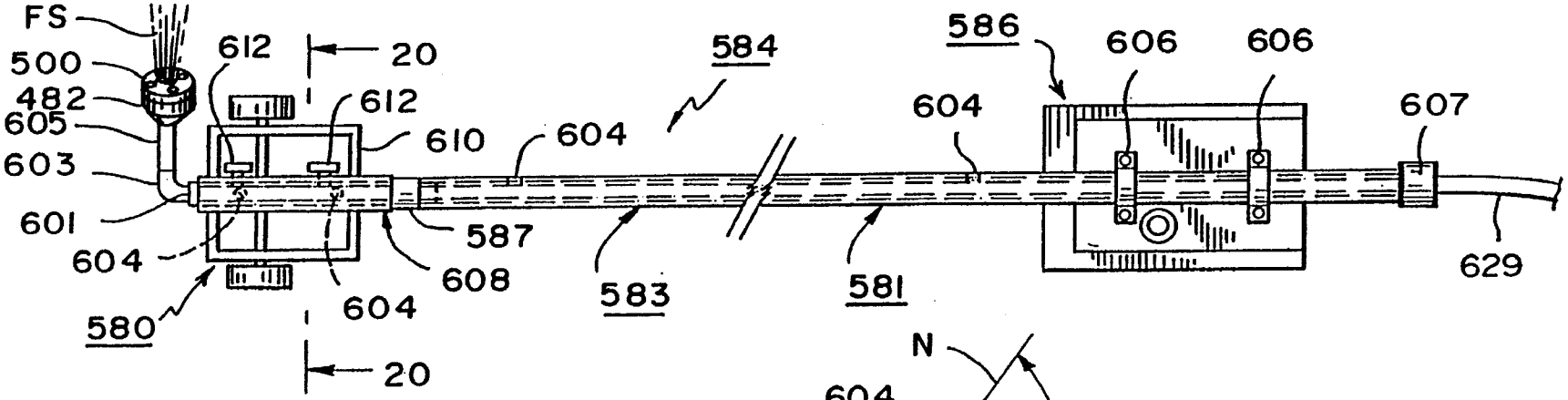
FIG. 19 is a plan view of the modified apparatus shown in FIG. 18.
Figure 20:
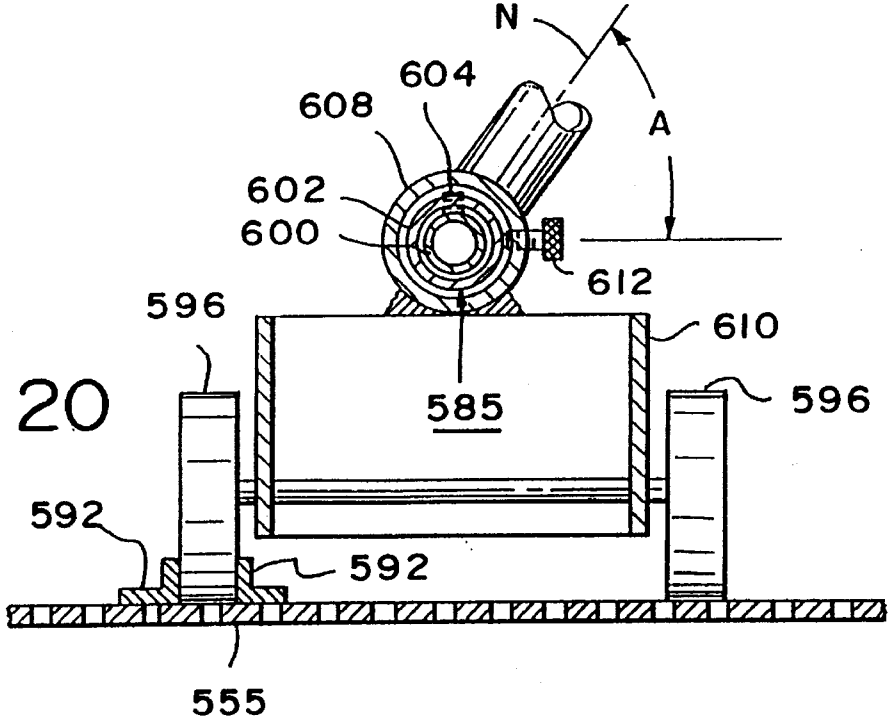
FIG. 20 is an elevational view in section taken along line 20—20 of FIG. 19.

Referring now to FIGS. 19 and 20, the conduit assembly 584 may include a plurality of sections 581, 583 and 585 detachably connected together by couplings 587, each section comprising an innermost high pressure water pipe 600 surrounded by a tubular safety shroud 602 which is clamped to water pipe 600 by two or more set screws 604,604. Pipe 600 is connected to the inlet of a nozzle body 482 through an end coupling 601, a 90° elbow 603 and a nozzle supporting pipe segment 605 of the same material as pipe 600. The end of pipe 600 opposite to nozzle 482 is connected to a source of high pressure water, such as high pressure pump 214, by a quick connector coupling 607 and the flexible high pressure hose 629. If water impact alone is sufficient, no media hose connection is needed. If media is to be mixed with the water, media transport lines, similar to media hose 263, base 260 and media tube 284, may also be mounted on nozzle cart 580 and trolley 586 along with conduit assembly 584.

Shroud 602 of section 581 (the longest) is clamped to trolley 586 by a pair of brackets 606,606 and shroud 602 of section 585 (the shortest) is clamped to a jacket 608 mounted on a frame 610 of cart 580. The clamping action between jacket 608 and shroud 602 of section 585 is provided by a pair of clamping screws having quick release knobs 612,612 so that these clamping screws are operable by hand to adjust the angle relative to the horizontal of axis OC of the fan spray FS discharged by nozzle cap 500. This angle is designated as angle A in FIG. 20 and sets the previously described acute angle of attack of the high pressure water spray relative to a plane tangent to drum surface 560.

Where the nozzle assembly has a spinning head, such as head 700 of assembly 650 (FIG. 15), the angle A is preferably set so that the spin axis N of the nozzle head makes an angle of about 65° to about 115°, preferably about 80° to about 100°, more preferably about 90° with an imaginary line tangent to drum surface 560 where it is immediately opposite to the spinning nozzle head. In addition, the tips and caps of the nozzle head are positioned relative to the spin axis N to provide the previously described angle of attack between spray axis OC and a plane tangent to the drum surface at its intersection with spin axis N. When using nozzle assembly 650 with the setup shown in FIGS. 17 and 18 to clean the perforated steel drums of a Fleissner dryer, the angle A is preferably in the range of about 35° to 40°.

Figure 21:
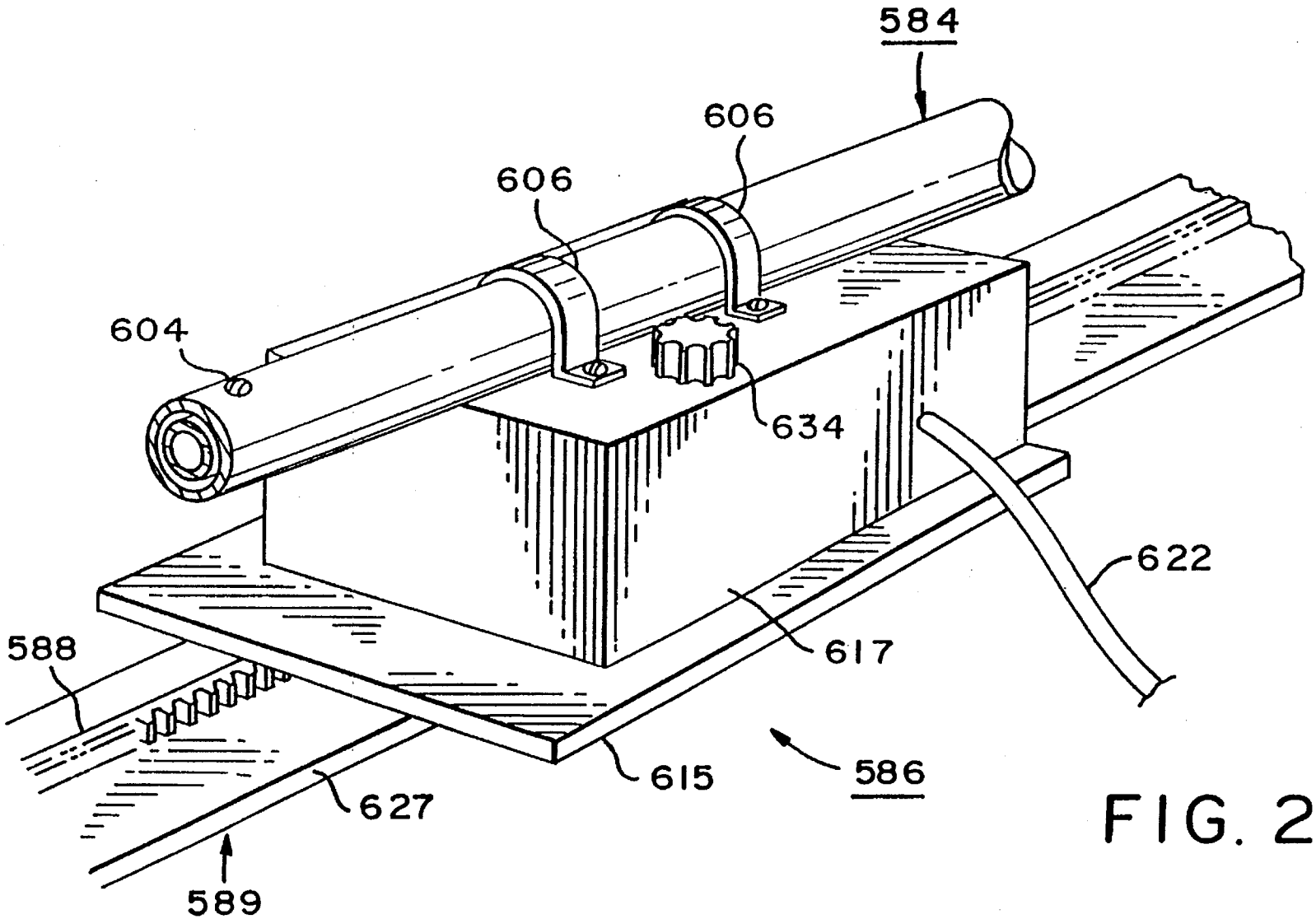
FIG. 21 is a fragmentary perspective view showing the drive trolley of the apparatus of FIG. 18.
Figure 23:
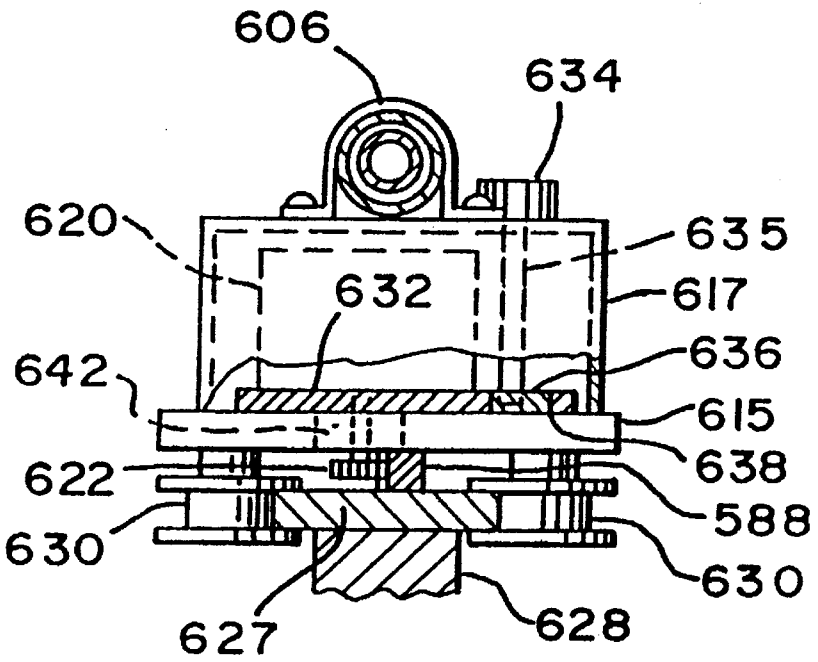
FIG. 23 is an elevational view in partial section of the drive trolley of FIG. 21.
Figure 22:
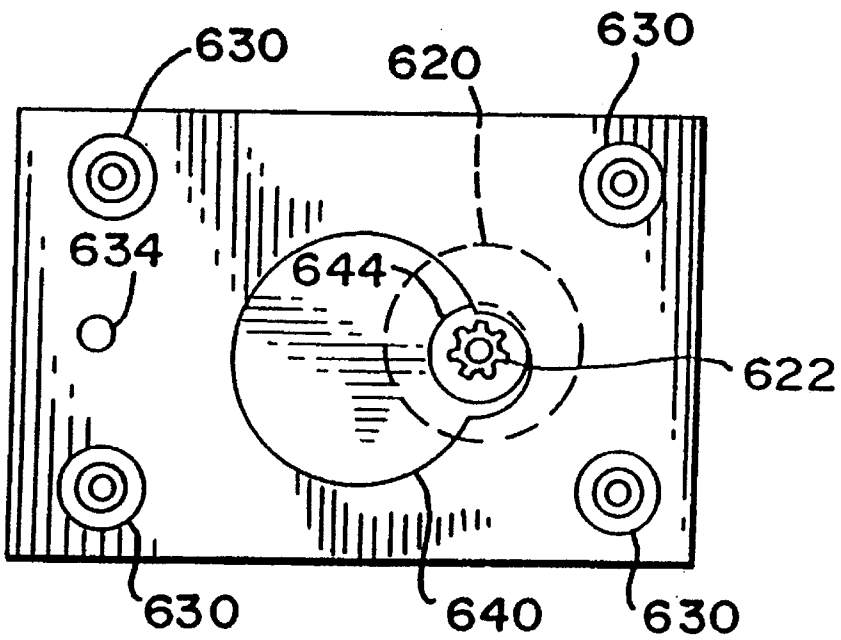
FIG. 22 is a bottom view of the drive trolley of FIG. 21.

As shown in FIG. 21, trolley 586 comprises a base plate 615 carrying a housing 617 to the top of which is bolted the conduit assembly 584 by the clamping brackets 606,606. Referring now to FIGS. 22 and 23, housing 617 contains a variable speed, reversible electric motor 620 which is connected by electrical lines 622 to a control panel 625 (Fig. 18). Motor 620 drives a pinion 622 which may engage rack 588 of track assembly 589 to move trolley 586 back and forth along the track assembly. Track assembly 589 includes a bed plate 627 for horizontally supporting rack 588, and bed plate 627 in turn is supported by a beam 628 each end of which is connected to a corresponding one of the stands 590. Rotatably mounted on base plate 615 of trolley 586 are two pairs of rollers 630 and 631, and one of each of these pairs engages an opposite side of bed plate 627 to support and guide trolley 586 for movement back and forth along track assembly 589.

A clutch assembly is provided for causing pinion 622 to be either engaged with or disengaged from rack 588. This clutch assembly comprises a sliding plate 632 on which motor 620 is mounted and which is arranged for sliding movement relative to housing base plate 615 around a pivot connection between plates 615 and 632 as provided by a pivot pin 634 (FIG. 22). The actuation of pivotal movement between plates 615 and 632 is provided by a hand operated knob 634 on the upper side of housing 617 and connected by a shaft 635 to an off center position of a cam element 636, which is received within an aperture 638 in sliding plate 632. A center portion of housing base plate 615 is cut out at 640 so as to provide for horizontal movement of the drive shaft 642 through which pinion 622 is driven by motor 620. A cut out 644 is also provided in sliding plate 632 to allow passage of motor drive shaft 642. Accordingly, the turning of knob 634 causes rotation of off-center cam 636 to thereby move pinion 622 laterally into and out of engagement with the teeth of rack 588.

Referring again to FIG. 18, control panel 625 replaces the instrument panel 142 of the embodiment of FIG. 2 and comprises a three position toggle switch 650 which provides for forward movement, reverse movement and stopping of trolley 586. Start and stop switches 652 and 653, respectively, are connected via an electrical cable 655 to high pressure water pump 214 which is arranged to supply city water to hose 237 at high pressure. Alternatively, start and stop switches 652 and 653 may be connected by cable 655 directly to a feed pump motor and a high pressure pump motor so as to activate and deactivate these motors, respectively, as disclosed in applicant's aforesaid U.S. Pat. No. 5,220,935. The reservoir and feed pump of this prior disclosure may also be connected to coupling 225 (FIG. 1) as the source of moderate pressure water for pump 214.

Control panel 625 also includes a fuse 657 and a running light 658, as well as a rheostat 660 for adjusting the speed at which trolley 586 and nozzle cart 580 are driven along their respective tracks. The speed of trolley motor 620 is thereby adjusted to select and control the speed of nozzle movement past the surface of dryer drum 560 relative to the rotational speed of the drum 556, the latter being rotated by its motor 566 which also may be an adjustable speed motor. Where the spinning head nozzle of FIG. 15 is mounted on cart 580, the rotational speed of head 700 also may be adjusted and controlled relative to both the translational speed of cart 580 and the rotational speed of drum 560.

In the preferred arrangement for cleaning Fleissner dryer drums, the free end of the nozzle cap or barrel is positioned about 5" to about 7" away from surface 560 and the width of the cleaned area for each drum rotation can be calculated from this distance and the angle of divergence of the fan spray in a plane parallel to the rotational axis of the drum. Each of the drums 556 are about 8.5 feet in diameter and therefore have a circumference of about 28 feet and may be rotated by motor 566 at a speed equivalent to about 51 linear feet of drum surface per minute. For this specific application, the speed of motor 620 is set by rheostat 660 such that trolley 586 advances nozzle 482 at a linear rate sufficient to provide a continuous spiral cleaning path around the drum surface that advances to remove coating 576 from drum surface 560 at a rate selected such that each 360° segment slightly overlaps the edge portion of the immediately preceding 360° segment throughout the next complete turn of the drum. Broken line 570 illustrates part of one 360° segment of the spiral path of nozzle 482 along surface 560 as produced by rotation of the drum relative to linear movement of nozzle cart 580. The speed of drum rotation and the rate of linear nozzle movement are preferably chosen such that substantially all of coating 576 is removed by a single pass of nozzle 482 over each 360° segment.

Although the present invention has been described with reference to the particular embodiments thereof, it will be understood by those skilled in the art that modifications may be made without departing from the scope of the invention. Accordingly, all modifications and equivalents which are properly within the scope of the disclosure presented in the instant specification and drawings are included in the present invention.

What is claims is:

1. An abrasive cleaning apparatus comprising:

a nozzle assembly comprising an impact chamber, a nozzle member defining a liquid orifice for discharging a liquid spray into said impact chamber along a spray axis, a media opening for discharging into said impact chamber along a media axis abrasive particles propelled by a transport gas, and a discharge passage for impinging said abrasive particles against a surface to be cleaned, said discharge passage communicating with said impact chamber for receiving and conveying said abrasive particles, said transport gas, and said liquid spray to the outside of said nozzle assembly;

liquid supply means for providing a flow of said liquid under pressure to said liquid orifice, the liquid spray discharged by said liquid orifice having an inner core substantially free of said transport gas; and, media supply means for providing a flow of an admixture of said abrasive particles and said transport gas under pressure to said media opening;

said media axis defining an incidence angle relative to said liquid spray axis, said liquid orifice having a shape for providing said liquid spray in a pattern having a transverse width dimension substantially larger than a transverse height dimension, said media opening being positioned relative to said liquid orifice shape to produce an impact area on a side of said spray pattern corresponding to said width dimension, said incidence angle and the velocity of said particles discharged along said media axis being sufficient to separate said abrasive particles from said transport gas and cause at least a substantial portion of said separated abrasive particles to impact said impact area of the liquid spray with sufficient kinetic energy to penetrate into and be carried by said inner core, the flow rates of said abrasive particles and said transport gas and the size of said media opening being such as to provide said particle velocity, a side of said spray pattern corresponding to said width dimension being spaced from a wall portion of said discharge passage by a gap providing a flow path for said separated transport gas to exit said impact chamber separately from said inner spray core, the gas pressure in said impact chamber being sufficient to propel a flow of said separated transport gas through said gap, and the size of said gap being such that said inner spray core remains substantially free of said transport gas as said transport gas, said abrasive particles and said liquid spray are conveyed to the outside of said nozzle assembly through said discharge passage.

2. An abrasive cleaning apparatus according to claim 1, wherein said incidence angle is in the range of about 60° to about 150°.

3. An abrasive cleaning apparatus according to claim 1, wherein said incidence angle is substantially greater than 90°.

4. An abrasive cleaning apparatus according to claim 1, wherein said incidence angle is at least about 90°.

5. An abrasive cleaning apparatus according to claim 1, wherein the sides of the spray pattern other than said gap side contact corresponding wall portions of said discharge passage.

6. An abrasive cleaning apparatus according to claim 1, wherein said gap and said media opening are on the same side of said spray pattern.

7. An abrasive cleaning apparatus according to claim 1, wherein the abrasive particles admixed with said transport gas are soluble in water, wherein said incidence angle is at least about 90°, and wherein said particle velocity is at least about 400 feet per second.

8. An abrasive cleaning apparatus according to claim 1, wherein said media supply means comprises a conduit for conveying said admixture of abrasive particles and transport gas to a media channel having a downstream end terminating at said media opening and an upstream end adjacent to a junction forming a sharp angle between said conduit and said media channel for causing said admixture to make an angular turn that is sufficiently sharp to provide a more even distribution of said abrasive particles throughout the area bounded by the shape of said media opening than would be provided by a radius turn.

9. An abrasive cleaning apparatus according to claim 8, wherein the cross-sectional area of at least a portion of said media channel is substantially less than the cross-sectional area of said conduit adjacent to said junction, the difference in said cross-sectional areas being sufficient for said transport gas to accelerate said particles to said impact velocity from a slower velocity in said supply conduit.

10. An abrasive cleaning apparatus according to claim 1, wherein the impact area produced by said media opening has a width substantially equal to a corresponding width of said spray pattern.

11. An abrasive cleaning apparatus according to claim 1, wherein said liquid spray has a fan type spray pattern which diverges outwardly from said impact chamber, wherein said impact chamber outlet comprises a slot having opposing sidewalls which diverge outwardly at an angle of divergence that corresponds substantially to an angle of divergence of said spray pattern, wherein said slot has first and second walls connecting said sidewalls and extending opposite to each other outwardly from said impact chamber, wherein said spray pattern is such that it contacts one of said connecting walls and is spaced from the other of said connecting walls by said gap, wherein said gap is of sufficient size to provide a flow path for said separated transport gas to exit said impact chamber without atomizing a portion of the liquid in said spray that would otherwise be atomized by said transport gas in the absence of said gas flow path, and wherein said other connecting wall and said media opening are on the same side of said spray pattern.

12. An abrasive cleaning apparatus comprising:

a nozzle assembly comprising an impact chamber, a nozzle member defining a liquid orifice for discharging a liquid spray into said impact chamber along a spray axis, a media opening for discharging into said impact chamber along a media axis abrasive particles propelled by a transport gas, and a discharge passage for impinging said abrasive particles against a surface to be cleaned, said discharge passage communicating with said impact chamber for receiving and conveying said transport gas and a mixture of said abrasive particles and said liquid spray to the outside of said nozzle assembly;

liquid supply means for providing a flow of said liquid under pressure to said liquid orifice; and, media supply means for providing a flow of an admixture of said abrasive particles and said transport gas under pressure to said media opening, the liquid spray discharged by said liquid orifice having an inner core substantially free of said transport gas, said media axis defining an incidence angle relative to said liquid spray axis, said incidence angle and the velocity of said particles discharged along said media axis being sufficient to separate said abrasive particles from said transport gas and cause at least a substantial portion of said separated abrasive particles to impact said liquid spray with sufficient kinetic energy to penetrate into and be carried by said inner core, the flow rates of said abrasive particles and said transport gas and the size of said media opening being such as to provide said particle velocity, said liquid orifice having a shape for providing said liquid spray in a pattern having a transverse width dimension substantially larger than a transverse height dimension, and a side of said spray pattern corresponding to said width dimension being spaced from a wall portion of said discharge passage by a gap of sufficient size to provide a flow path for said separated transport gas to exit said impact chamber separately from said inner spray core such that said inner spray core remains substantially free of said transport gas as said abrasive particles, said separated transport gas, and said liquid spray are conveyed to the outside of said nozzle assembly through said discharge passage dimension substantially larger than a transverse height dimension, and a side of said spray pattern corresponding to said width dimension being spaced from a wall portion of said discharge passage by a gap of sufficient size to provide a flow path for said separated transport gas to exit said impact chamber separately from said inner spray core such that said inner spray core remains substantially free of said transport gas as said abrasive particles, said separated transport gas, and said liquid spray are conveyed to the outside of said nozzle assembly through said discharge passage.

13. An abrasive cleaning apparatus according to claim 12, wherein said incidence angle is substantially greater than 90°.

14. An abrasive cleaning apparatus according to claim 12 , wherein said media supply means comprises a conduit for conveying said admixture of abrasive particles and transport gas to a media channel having a downstream end terminating at said media opening and an upstream end adjacent to a junction forming a sharp angle between said conduit and said media channel for causing said admixture to make an angular turn that is sufficiently share to provide a more even distribution of said abrasive particles throughout the area bounded by the shape of said media opening than would be provided by a radius turn.

15. An abrasive cleaning apparatus according to claim 14, wherein the cross-sectional area of at least a portion of said media channel is substantially less than the cross-sectional area of said conduit adjacent to said junction, the difference in said cross-sectional areas being sufficient for said transport gas to accelerate said particles to said impact velocity from a slower velocity in said supply conduit.

16. An abrasive cleaning apparatus according to claim 12, wherein the sides of the spray pattern other than said gap side contact corresponding wall portions of said discharge passage.

17. An abrasive cleaning apparatus according to claim 12, wherein said incidence angle is in the range of about 60° to about 150°.

18. An abrasive cleaning apparatus according to claim 12, wherein said incidence angle is substantially greater than 90°.

19. An abrasive cleaning apparatus according to claim 12, wherein said gap and said media opening are on the same side of said spray pattern.

20. An abrasive cleaning apparatus according to claim 12, wherein the abrasive particles admixed with said transport gas are soluble in water, wherein said incidence angle is at least about 90°, and wherein said particle velocity is at least about 400 feet per second.

21. An abrasive cleaning apparatus according to claim 12, wherein the impact area produced by said media opening has a width substantially equal to a corresponding width of said spray pattern.

22. An abrasive cleaning apparatus according to claim 12, wherein said liquid spray has a fan type spray pattern which diverges outwardly from said impact chamber, wherein said impact chamber outlet comprises a slot having opposing sidewalls which diverge outwardly at an angle of divergence that corresponds substantially to an angle of divergence of said spray pattern, wherein said slot has first and second walls connecting said sidewalls and extending opposite to each other outwardly from said impact chamber, wherein said spray pattern is such that it contacts one of said connecting walls and is spaced from the other of said connecting walls by said gap, and wherein said other connecting wall and said media opening are on the same side of said spray pattern.

23. An abrasive cleaning apparatus according to claim wherein said incidence angle is at least about 90°.

24. A method of abrasive cleaning comprising:

providing a flow of liquid under pressure from a liquid supply means to a liquid orifice defined by a nozzle member of a nozzle assembly;

providing a flow of an admixture of abrasive particles and a transport gas under pressure, said particles being propelled by said transport gas from a media supply means to a media opening defined by said nozzle assembly;

discharging a liquid spray through said liquid orifice into an impact chamber along a spray axis, said impact chamber being defined by said nozzle assembly, and the liquid spray discharged by said liquid orifice having an inner core substantially free of said transport gas;

discharging said admixture of abrasive particles and transport gas through said media opening into said impact chamber along a media axis; and, conveying said abrasive particles, said transport gas and said liquid spray to the outside of said nozzle assembly through a discharge passage for impinging said abrasive particles against a surface to be cleaned, said discharge passage communicating with said impact chamber and being defined by said nozzle assembly;

said media axis defining an incidence angle relative to said liquid spray axis, said liquid orifice having a shape for providing said liquid spray in a pattern having a transverse width dimension substantially larger than a transverse height dimension, said media opening being positioned relative to said orifice shape to produce an impact area on a side of said spray pattern corresponding to said width dimension, said incidence angle and the velocity of said particles discharged along said media axis being sufficient to separate said abrasive particles from said transport gas and cause at least a substantial portion of said separated abrasive particles to impact said impact area of the liquid spray with sufficient kinetic energy to penetrate into and be carried by said inner core, the flow rates of said abrasive particles and said transport gas and the size of said media opening being such as to provide said particle velocity, a side of said spray pattern corresponding to said width dimension being spaced from a wall portion of said discharge passage by a gap providing a flow path for said separated transport gas to exit said impact chamber separately from said inner spray core, the gas pressure in said impact chamber being sufficient to propel a flow of said separated transport gas through said gap, and the size of said gap being such that said inner spray core remains substantially free of said transport gas as said transport gas, said abrasive particles and said liquid spray are conveyed to the outside of said nozzle assembly through said discharge passage.

25. A method of abrasive cleaning according to claim 24, wherein the sides of the spray pattern other than said gap side contact corresponding wall portions of said discharge passage.

26. A method of abrasive cleaning according to claim 24, wherein said method further comprises the step of conveying said admixture of abrasive particles and transport gas through a conduit to a media channel having a downstream end terminating at said media opening and an upstream end adjacent to a junction forming a sharp angle between said conduit and said media channel for causing said admixture to make an angular turn that is sufficiently sharp to provide a more even distribution of said abrasive particles throughout the area bounded by the shape of said media opening than would be provided by a radius turn.

27. A method of abrasive cleaning according to claim 26, wherein the cross-sectional area of at least a portion of said media channel is substantially less than the cross-sectional area of said conduit adjacent to said junction, the difference in said cross-sectional areas being sufficient for said transport gas to accelerate said particles to said impact velocity from a slower velocity in said supply conduit.

28. A method of abrasive cleaning according to claim 24, wherein the impact area produced by said media opening has a width substantially equal to a corresponding width of said spray pattern.

29. A method of abrasive cleaning according to claim 24, wherein the size of said gap is sufficient to prevent atomization of a portion of the liquid in said spray that would otherwise be atomized by said transport gas flow in the absence of said gas flow path.

30. A method of abrasive cleaning comprising:

providing a flow of liquid under pressure from a liquid supply means to a liquid orifice defined by a nozzle member of a nozzle assembly;

providing a flow of an admixture of abrasive particles and a transport gas under pressure, said particles being propelled by said transport gas from a media supply means to a media opening defined by said nozzle assembly;

discharging a liquid spray through said liquid orifice into an impact chamber along a spray axis, said impact chamber being defined by said nozzle assembly, and the liquid spray discharged by said liquid orifice having an inner core substantially free of said transport gas;

discharging said admixture of abrasive particles and transport gas through said media opening into said impact chamber along a media axis; and, conveying said transport gas and a mixture of said abrasive particles and said liquid spray to the outside of said nozzle assembly through a discharge passage for impinging said abrasive particles against a surface to be cleaned, said discharge passage communicating with said impact chamber and being defined by said nozzle assembly;

said media axis defining an incidence angle relative to said liquid spray axis, said incidence angle and the velocity of said particles discharged along said media axis being sufficient to separate said abrasive particles from said transport gas and cause at least a substantial portion of said separated abrasive particles to impact said impact area of the liquid spray with sufficient kinetic energy to penetrate into and be carried by said inner core, the flow rates of said abrasive particles and said transport gas and the size of said media opening being such as to provide said particle velocity, said liquid orifice having a shape for providing said liquid spray in a pattern having a transverse width throughout the area bounded by the shape of said media opening than would be provided by a radius turn.

31. A method of abrasive cleaning according to claim 30, wherein said incidence angle is greater than 90°.

32. A method of abrasive cleaning according to claim 30, wherein said method further comprises the step of conveying said admixture of abrasive particles and transport gas through a conduit to a media channel having a downstream end terminating at said media opening and an upstream end adjacent to a junction forming a sharp angle between said conduit and said media channel for causing said admixture to make an angular turn that is sufficiently sharp to provide a more even distribution of said abrasive particles.

33. A method of abrasive cleaning according to claim 32, wherein the cross-sectional area of at least a portion of said media channel is substantially less than the cross-sectional area of said conduit adjacent to said junction, the difference in said cross-sectional areas being sufficient for said transport gas to accelerate said particles to said impact velocity from a slower velocity in said supply conduit.

34. An abrasive cleaning apparatus comprising:

a nozzle assembly comprising an impact chamber, a nozzle member defining a liquid orifice for discharging a liquid spray into said impact chamber along a spray axis, a media opening for discharding into said impact chamber along a media axis abrasive particles propelled by a transport gas, and a discharge passage for impinging said abrasive particles against a surface to be cleaned, said discharge passage communicating with said impact chamber for receiving and conveying said abrasive particles, said transport gas, and said liquid spray to the outside of said nozzle assembly;

liquid supply means for providing a flow of said liquid under pressure to said liquid orifice, the liquid spray discharged by said liquid orifice having an inner core substantially free of said transport gas; and, media supply means for providing a flow of an admixture of said abrasive particles and said transport gas under pressure to said media opening; and, means for discharging said transport gas from said impact chamber such that the inner core of said liquid spray remains substantially free of said transport gas while being conveyed through said outlet, said media axis defining an incidence angle relative to said liquid spray axis, said liquid orifice having a shape for providing said liquid spray in a pattern having a transverse width dimension substantially larger than a transverse height dimension, said media opening being positioned relative to said liquid orifice shape to produce an impact area on a side of said spray pattern corresponding to said width dimension, said incidence angle and the velocity of said particles discharged along said media axis being sufficient to separate said abrasive particles from said transport gas and cause at least a substantial portion of said separated abrasive particles to impact said impact area of the liquid spray with sufficient kinetic energy to penetrate into and be carried by said inner core, said media supply means comprising a conduit for conveying said admixture of abrasive particles and transport gas to a media channel having a downstream end terminating at said media opening and an upstream end adjacent to a junction forming a sharp angle between said conduit and said media channel for causing said admixture to make an angular turn that is sufficiently sharp to provide a more even distribution of said abrasive particles throughout the area bounded by the shape of said media opening than would be provided by a radius turn, the cross-sectional area of at least a portion of said media channel being substantially less than the cross-sectional area of said conduit adjacent to said junction, the difference in said cross-sectional areas being sufficient for said transport gas to accelerate said particles to said impact velocity from a slower velocity in said supply conduit, and the flow rates of said abrasive particles and said transport gas and the cross-sectional area of said portion of the media channel being such as to provide said impact velocity.

35. An abrasive cleaning apparatus according to claim 34, wherein said sharp angular turn is through an angle in the range of about 60° to about 150°.

36. An abrasive cleaning apparatus according to claim 34, wherein said sharp angular turn is through an angle of at least about 90°.

* * * * *

UNITED STATES PATENT AND TRADEMARK OFFICE

CERTIFICATE OF CORRECTION

PATENT NO. : 5,551,909
DATED : September 3, 1996
INVENTOR(S) : DONALD C. BAILEY

It is certified that error appears in the above-indentified patent and that said Letters Patent is hereby corrected as shown below:

Column 24, delete lines 30-40, and line 61, change "share" to --sharp--.

Column 27, line 33, delete "throughout", and delete lines 34-35 and insert --dimension substantially larger than a transverse height dimension, and a side of said spray pattern corresponding to said width dimension being spaced from a wall portion of said discharge passage by a gap of sufficient size to provide a flow path for said separated transport gas to exit said impact chamber separately from said inner spray core such that said inner spray core remains substantially free of said transport gas as said abrasive particles, said separated transport gas, and said liquid spray are conveyed to the outside of said nozzle assembly through said discharge passage.--; and

UNITED STATES PATENT AND TRADEMARK OFFICE

CERTIFICATE OF CORRECTION

PATENT NO. : 5,551,909

DATED : September 3, 1996

INVENTOR(S) : DONALD C. BAILEY

It is certified that error appears in the above-indentified patent and that said Letters Patent is hereby corrected as shown below:

Column 27, line 58, change "discharding" to --discharging--.

Signed and Sealed this

Twenty-fourth Day of December, 1996

*Attest:*

Bruce Lehman

BRUCE LEHMAN

*Attesting Officer*

*Commissioner of Patents and Trademarks*